US007140152B2

(12) United States Patent
Thaler

(10) Patent No.: US 7,140,152 B2
(45) Date of Patent: Nov. 28, 2006

(54) SNOW GUARD DEVICE

(76) Inventor: Ken Thaler, 10 Deep Water Road, P.O. Box 262, Parry Sound, Ontario (CA) P2A 2X4

( * ) Notice: Subject to any disclaimer, the term of this patent is extended or adjusted under 35 U.S.C. 154(b) by 190 days.

(21) Appl. No.: 10/887,206

(22) Filed: Jul. 8, 2004

(65) Prior Publication Data

US 2005/0044752 A1 Mar. 3, 2005

(30) Foreign Application Priority Data

Sep. 3, 2003 (CA) ..... 2440420
Mar. 23, 2004 (CA) ..... 2461644

(51) Int. Cl.
*E04D 13/10* (2006.01)

(52) U.S. Cl. ..... 52/25; 37/196

(58) Field of Classification Search ..... 52/24–26; 37/196

See application file for complete search history.

(56) References Cited

U.S. PATENT DOCUMENTS 472,014 A * 3/1892 Densmore ..... 52/15
529,774 A * 11/1894 Baird ..... 52/25
1,925,263 A * 9/1933 Levow ..... 52/25
5,152,107 A 10/1992 Strickert ..... 52/24
6,256,934 B1 7/2001 Alley ..... 52/25
6,298,608 B1 10/2001 Alley ..... 52/25
6,318,028 B1 11/2001 Alley ..... 52/25
6,357,184 B1 * 3/2002 Alley ..... 52/25
6,385,914 B1 5/2002 Alley ..... 52/25

* cited by examiner

*Primary Examiner*—Meredith C. Petravick
(74) *Attorney, Agent, or Firm*—Kusner & Jaffe

(57) ABSTRACT

The present invention relates to a snow guard device for use on a sloped roof having a roof decking supported by a roof substructure. The roof decking may have a plurality of elongate corrugations transversely spaced therealong. The snow guard device includes a pair of posts anchored to longitudinal members mounted to the roof substructure and extending proud of the roof decking. The posts support a rail member, which extends transversely of the elongate corrugations. The snow guard device further includes a pair of mounting brackets, which are fastened to the rail member. The mounting brackets are oriented to extend upslope and substantially downwardly toward the roof decking. The brackets carry a plurality of snow barrier members therebetween for discouraging snow from downwardly sliding along the roof decking. The snow barrier members are positioned at a location upslope of the support means and are sized to correspond generally to the spacing between a pair of adjacent corrugations. The snow guard device may also be used on other types of sloped roof surfaces, for instance, those having standing seams.

29 Claims, 18 Drawing Sheets

SNOW GUARD DEVICE

FIELD OF THE INVENTION

The present invention relates to a snow guard device for use on a sloped roof to prevent snow and ice which has accumulated thereon from sliding and falling onto people or property below.

BACKGROUND OF THE INVENTION

In geographic regions, which receive substantial snowfall, the hazards of falling snow or ice pose problems, particularly, for buildings or structures having a sloped metal roof surface or decking. These problems tend to be significantly exacerbated where the pitch of the roof decking is severe. The problems are caused, in part, by the fact that there is typically little friction between the roof decking and the snow to counteract the action of gravity and inhibit the snow from sliding off the roof decking. Moreover, ice sheets often form on the roof decking because the roof decking, being made of metal, tends to absorb heat from the structure or building. This heat melts the snow accumulated on the roof decking and forms ice sheets that can then slide off the roof decking potentially injuring people on the ground or causing damage to property.

Attempts have been made to control or restrain the sliding movement of snow or ice on sloped roof surfaces by installing snow guard devices on the roof decking. Conventional snow guard devices often include a pair of brackets with mounting blocks secured directly to the roof decking or to an underlying roof substructure, and a plurality of straight rods extending between the pair of brackets, which serve to block the sliding movement of snow. However, this type of snow guard is not particularly well-suited for corrugated roof surfaces or roof surfaces of the type having standing seams as it tends to require that the mounting blocks be mounted between each pair of adjacent corrugations or adjacent standing seams (as the case may be), with each mounting block requiring individual attachment to the roof decking or roof substructure.

In the case of corrugated roof decking, each of the brackets or mounting brackets may be secured to ridges of the corrugations by fasteners. This installation may be time consuming and may require puncturing the roof decking to form holes to accommodate the bolts or screws used to secure the snow guard device onto the roof decking. The large number of punctures thus created tends to compromise the imperviousness of the roof decking.

In the case of roof decking with a standing seam, various ways of attaching the brackets to the roof decking have been devised.

Typically, the manner of attachment involves securing the brackets or mounting blocks to the standing seams either with screws or bolts. However, this too can result in tearing or puncturing of the standing seams, which could compromise the watertight seal between adjoining roof panels. Alternatively, clamping mechanisms, which frictionally engage the standing seam to hold the snow guard device in place, have been used. However, these types of mechanisms tend to be susceptible to separating from the standing seam when the force exerted by the snow load exceeds the friction force between the contact surface of the clamp mechanism and the standing seam. This creates further hazards as the snow guard device could itself become detached from the roof decking and fall off the sloped roof.

Accordingly, it would be desirable to have a snow guard device which would tend to minimize the number of punctures created in the roof decking and which could be secured to the roof decking in a safe, stable manner.

It would further be advantageous to have a versatile snow guard device, which could be used, on different types of sloped roof surfaces, particularly those having standing seams and corrugations.

SUMMARY OF THE INVENTION

According to one aspect of the invention, there is provided a snow guard device for use on a sloped roof having a roof decking supported by a roof substructure. The roof decking has a plurality of roof panels mounted side-by-side. The plurality of roof panels are attached along their respective adjoining edges to form a plurality of elongate standing seams. The standing seams extend in a direction substantially parallel to the slope of the sloped roof, and are transversely spaced along the roof decking. The snow guard device includes support means mountable to extend proud of the roof decking. The support means are anchored to longitudinal support means mounted to the roof substructure when the snow guard device is operatively connected to the sloped roof. Also provided is rail means for mounting on the support means transversely of the standing seams and in vertically spaced relation to the roof decking. The snow guard device further includes bracket means rigidly attachable to the rail means and snow barrier means supportable on the bracket means to impede snow from downwardly sliding along the roof decking. The snow barrier means is positionable between a pair of adjacent standing seams at a location upslope of the support means.

In an additional feature, the support means includes two posts. The posts are transversely spaced from each other to support the rail means when the snow guard device is operatively connected to the sloped roof. In a further feature, the posts are positionable to extend substantially perpendicular to the roof decking. In yet another feature, the posts are positionable to extend in substantially skewed relation relative to the roof decking.

In an additional feature, the longitudinal support means includes two longitudinal support members mounted to the roof substructure.

In an additional feature, the rail means includes a rail member. The rail member is positionable to extend between the posts.

Each post has a top end for fastening to the rail member and a bottom end for anchoring to a longitudinal support member, which in turn is mounted to the roof substructure. The snow guard device further includes fastening means for firmly securing the rail member to the top end of each post. In a further feature, the fastening means includes a connector formed with a passageway adapted to receive an end of the rail member therethrough in substantial close fitting contact. In one embodiment, the connector has a generally planar face for abutting the top end of the post, and a pair of flanges extending beyond the planar face for fastening to the top end of the post. In another embodiment, the connector is tubular with a centre slotted aperture adapted to securely co-operate with a planar member projecting from the top of the post.

In still another feature, the bracket means includes a plurality of pairs of brackets mountable side-by-side for attachment to the rail member. Each pair of brackets is mountable between a pair of adjacent standing seams. Each pair of brackets is positionable to extend upslope and substantially downwardly toward the roof decking. The plurality of pairs of brackets includes a first pair of brackets, a second pair of brackets, and a third pair of brackets. The first, second and third pairs of brackets are mountable in transversely spaced relation to each other. In an additional feature, one of the brackets of the first pair is positionable in abutting relation with one of the brackets of the second pair.

In still another feature, the bracket means includes a pair of brackets mountable between a pair of adjacent standing seams. Each pair of brackets is positionable to extend upslope and substantially downwardly toward the roof decking. In an additional feature, each bracket has a proximal portion for attaching to the rail member, a distal portion for locating adjacent the roof decking, and an intermediate portion joining the proximal portion to the distal portion. The barrier means are mountable between the distal portions of the brackets. In yet a further feature, each bracket has a flange member reinforced with a web member. The web member extends between the proximal and distal portions of the bracket. The snow barrier means is attachable to the web members of the brackets at the distal portions thereof. In a further still feature, the proximal portion of each bracket includes a clevis for fastening engagement with the rail member.

In yet another feature, each bracket has a generally doglegged profile. In an additional feature, the generally doglegged profile of each bracket is defined by a first bend formed therein at the juncture between the proximal portion and the intermediate portion, and a second bend formed therein at the juncture between the intermediate portion and the distal portion. In another additional feature, the generally doglegged profile of each bracket is defined by a bend formed therein at the juncture between the proximal portion and the intermediate portion.

In another feature, the snow barrier means includes at least one crossbeam sized to substantially correspond to the transverse spacing between a pair of adjacent standing seams. In additional feature, the snow barrier means includes three crossbeams. In a further additional feature, when operatively connected to the bracket means, the three crossbeams co-operate with each other to define a snow abutting face. The snow abutting face is positionable substantially perpendicular to the roof decking. Additionally, the snow abutting face is directed away from the guide means. In another additional feature, the snow abutting face is positionable to have a generally skewed orientation relative to the roof decking.

According to another aspect of the invention, there is provided a snow guard device for use on a sloped roof having a roof decking supported by a roof substructure. The roof decking has a plurality of elongate corrugations extending substantially parallel to the slope of the roof decking. The elongate corrugations are transversely spaced along the roof decking. The snow guard device includes support means mountable to extend proud of the roof decking. The support means is anchored to a longitudinal support means mounted to the roof substructure when the snow guard device is operatively connected to the sloped roof. Also provided is rail means for mounting on the support means transversely of the corrugations and in vertically spaced relation to the roof decking. The snow guard device further includes bracket means rigidly attachable to the rail means and snow barrier means supportable on the bracket means to discourage snow from downwardly sliding along the roof decking. The snow barrier means is positionable between a pair of adjacent corrugations at a location upslope of the support means

BRIEF DESCRIPTION OF THE DRAWINGS

The present invention may be further understood by reference to the following detailed description of the embodiments of the invention, taken in conjunction with the accompanying drawings, in which.

DETAILED DESCRIPTION OF A PREFERRED EMBODIMENT

Figure 1:
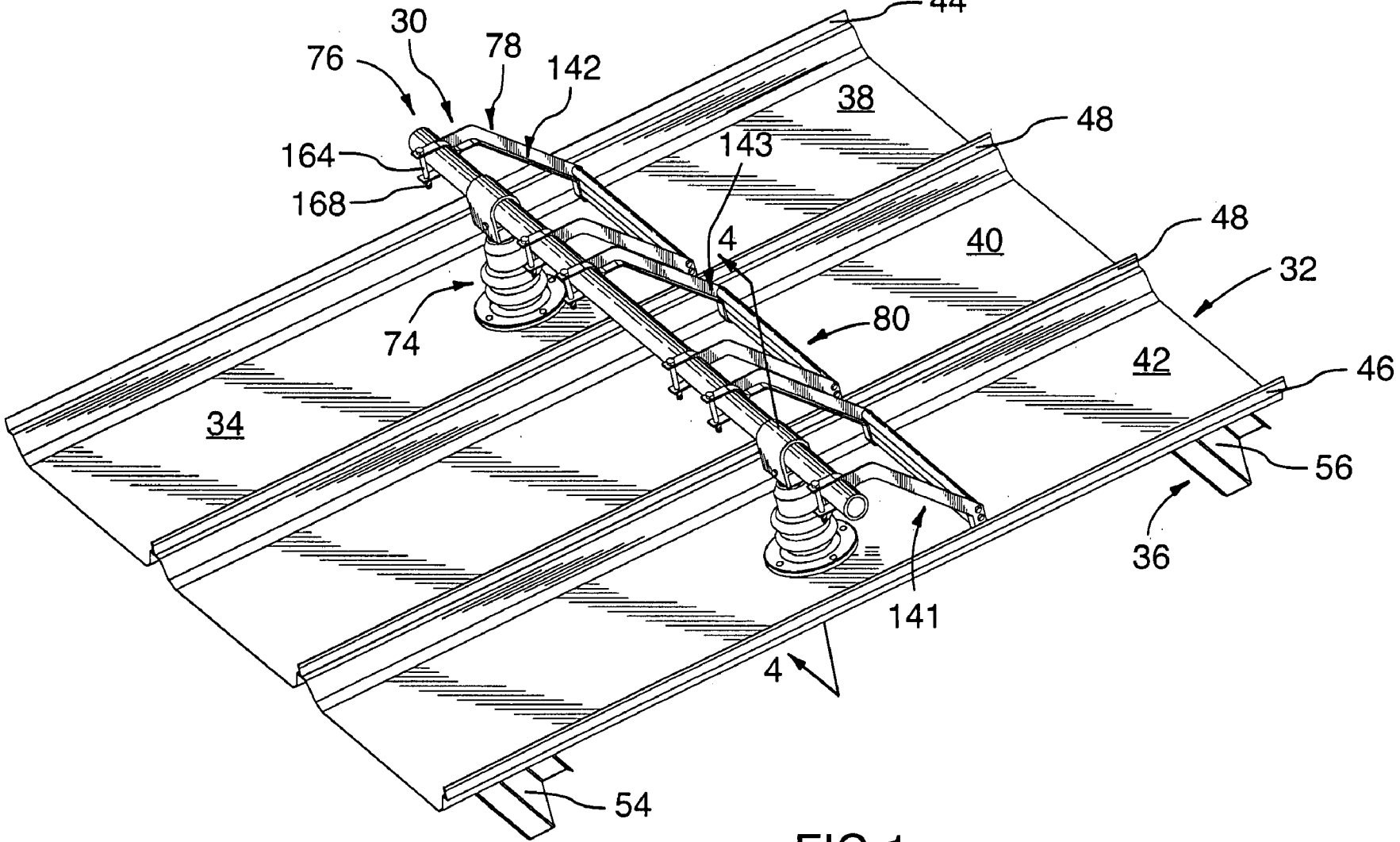
FIG. 1 is a front, right perspective view of a snow guard device according to a preferred embodiment of the present invention, showing the snow guard device operatively mounted onto a first type of sloped roof surface.

The description, which follows, and the embodiments described therein, are provided by way of illustration of an example, or examples of particular embodiments of principles and aspects of the present invention. These examples are provided for the purposes of explanation, and not of limitation, of those principles and of the invention. In the description that follows, like parts are marked throughout the specification and the drawings with the same respective reference numerals.

Figure 2:
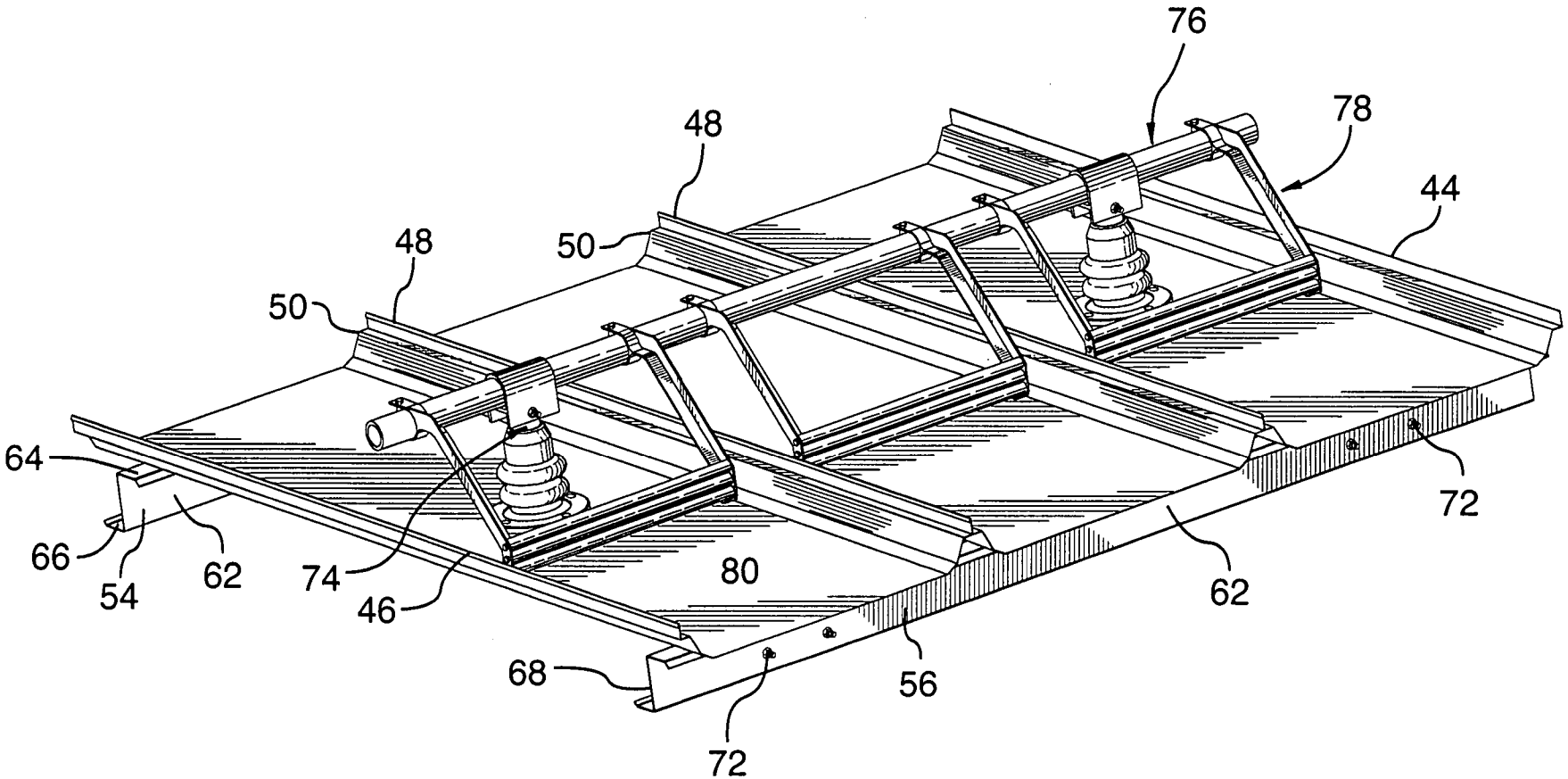
FIG. 2 is a rear, right perspective view of the snow guard device shown in FIG. 1.
Figure 3:
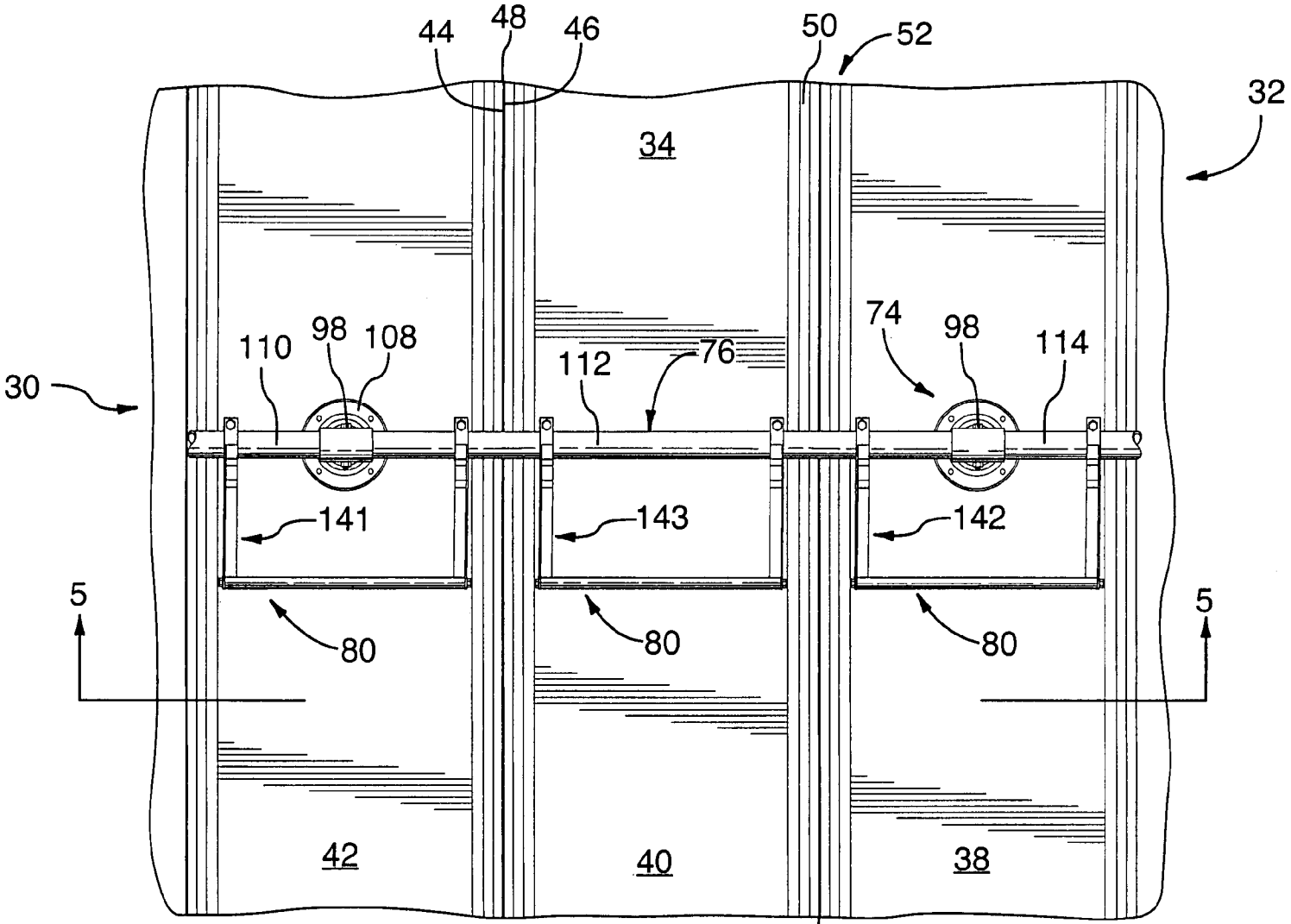
FIG. 3 is a top plan view of the snow guard device shown in FIG. 2.
Figure 4:
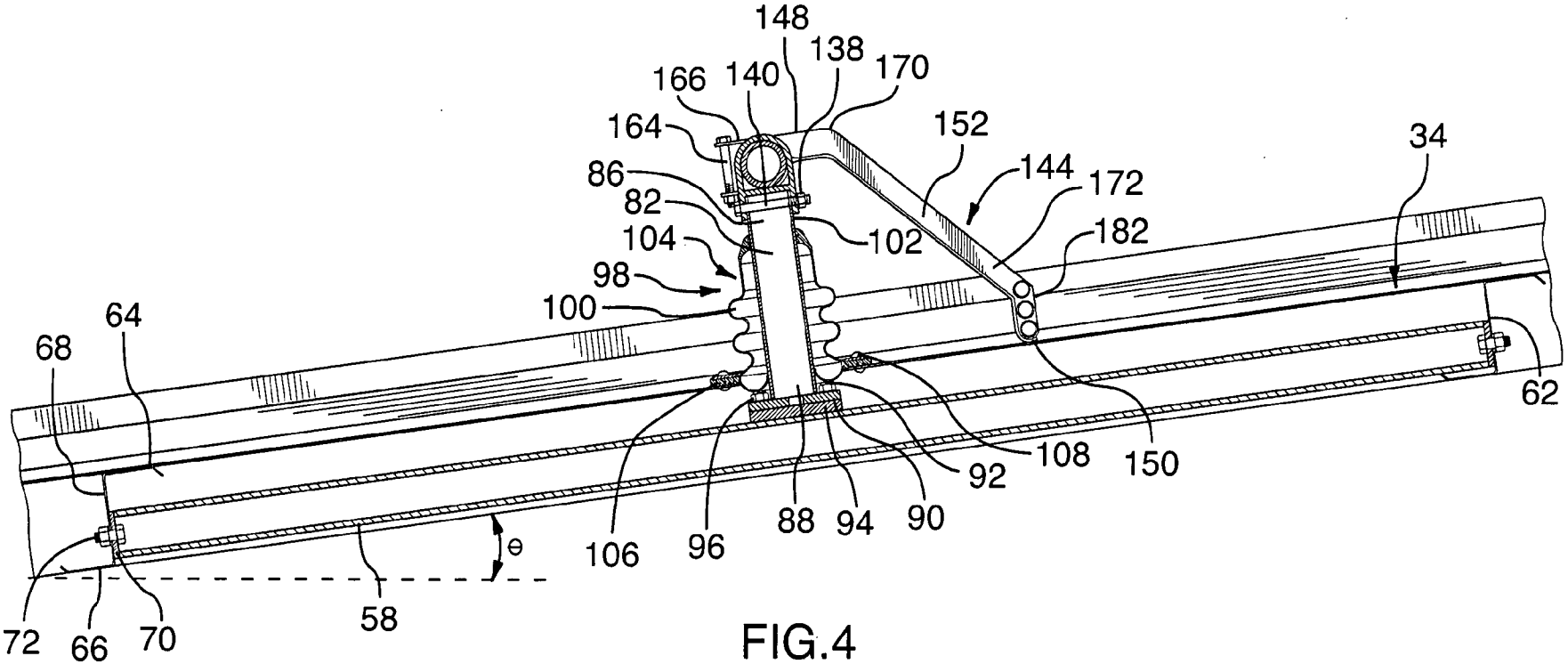
FIG. 4 is a cross-sectional view of the snow guard device shown in FIG. 1 taken along section '4—4' thereof.

Referring to FIGS. 1 through 5, a snow guard device, generally designated with reference numeral 30, is shown operatively mounted to a sloped or pitched roof 32 set on an angle θ measured from the horizontal (as shown in FIG. 4). In the preferred embodiment, the angle θ is 8° degrees. However, it will be appreciated that the pitch of the roof may vary significantly depending on the structure.

Figure 5:
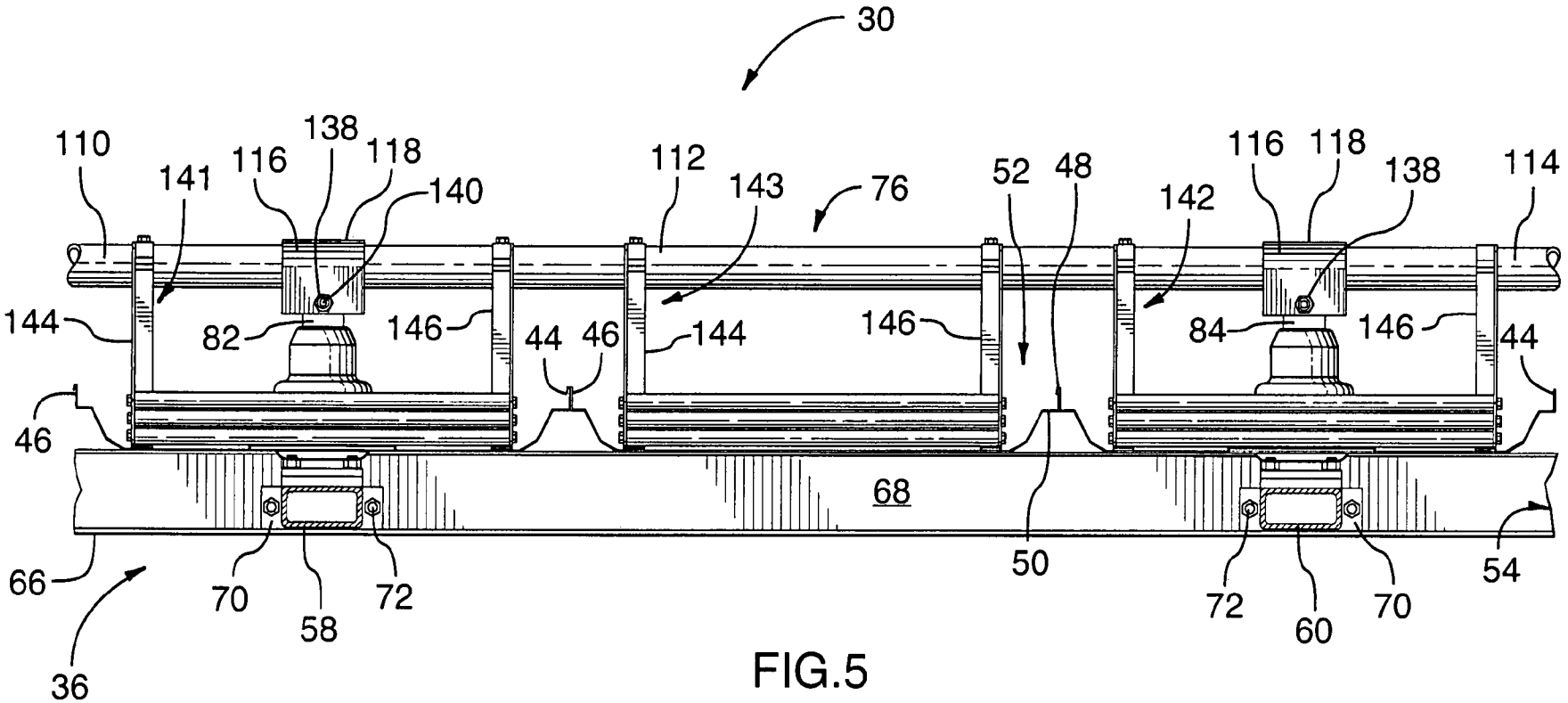
FIG. 5 is a cross-sectional view of the snow guard device shown in FIG. 3 taken along section '5—5' thereof.

With specific reference to FIGS. 3 and 5, the sloped roof 32 is of a known construction having a metal, outer roof surface in the nature of sloped roof decking 34, overlying a roof substructure 36. The roof decking 34 is formed from a plurality of elongate roof panels 38, 40 and 42, each measuring 24 inches wide, arranged side-by-side. Each roof panel 38, 40, 42 laterally terminates with generally raised, upturned, edges 44 and 46 which extend along the entire length thereof. Adjoining roof panels 38 and 40, and roof panels 40 and 42, abut along their respective raised edges 44 and 46. During assembly of the roof decking 34, the abutting raised edges 44 and 46 of the adjoining roof panels are crimped as known in the art to form a joint in the nature of a standing, double-lock seam 48 which seals the adjoining roof panels 38 and 40, and 40 and 42, and prevents moisture from penetrating below the roof decking 34 into the roof substructure 36. The standing seams 48 extend in a direction substantially parallel to the slope of the roof decking 34, and are transversely spaced therealong. In the preferred embodiment, the seams 48 are spaced from each other a distance of 24 inches. Ridges 50 having a generally trapezoidal profile are formed at the location of the standing seams 48. The ridges 50 define, in part, a plurality of elongate corrugations 52. A roof decking system such as the one described above is available from Butler Manufacturing Company of Kansas City, Mo. It is known as the MR-24® Roof System.

The roof substructure 36 supports the roof decking 34. The roof substructure 36 includes at least two transverse support members 54 and 56. As best shown in FIGS. 2 and 4, each transverse support members 54, 56 is a generally, Z-shaped structural channel 62 having a pair of opposed, upper and lower flanges 64 and 66 joined by an intermediate web 68. Each structural channel 62 is positioned with its intermediate web 68 substantially upright. The structural channels 62 are longitudinally spaced from each other to support the roof panels 38, 40, and 42 spanning therebetween. In the preferred embodiment, the longitudinal spacing between adjacent structural channels is 60 inches. The upper flanges 64 of the structural channels 62 support the roof panels 38, 40, and 42.

Referring to FIG. 5, each longitudinal support member 58, 60 has a generally rectangular cross-section and is attached to a conventional underlying support structure (not shown) along one of its long sides. In the preferred embodiment, the longitudinal support members 58 and 60 are transversely spaced from each other a distance of 48 inches, measured centre-to-centre. Each longitudinal support member 58 and 60 is provided with an end plate 70 to permit fastening of the longitudinal support member 58, 60 (as the case may be) to the intermediate webs 68 of the structural channels 62 with bolts 72.

Referring to FIG. 1 and 2, the snow guard device 30 includes: support means 74 adapted for anchoring to the longitudinal support member 58 mounted to roof substructure 36 and mountable to extend proudly of the roof decking 34; rail means 76 for mounting between the support means 74 transversely of the standing seams 48; bracket means 78 rigidly attachable to the rail means 76; and snow barrier means 80 supportable on the bracket means 78 between a pair of adjacent standing seams 48 to discourage snow from downwardly sliding along the roof panels 38, 40 and 42 of the roof decking 34. As will become apparent from the detailed description that follows, the support means 74, the longitudinal support member 58, the rail means 76, the bracket means 78 and the snow barrier means 80 tend to form an integrated, stable structure capable of withstanding significant snow and ice loads.

Referring to FIGS. 4 and 5, the support means 74 includes a plurality of substantially upright support members in the nature of posts 82 and 84. Preferably, the posts 82 and 84 are generally tubular and are fabricated from aluminum. Each post 82, 84 has a top end 86 for fastening to the rail means 76 and a bottom end 88 for connection to the longitudinal support member 58. A generally square base plate 90 is mounted to the bottom end 88 of each post 82, 84 to permit anchoring of the post 82, 84 (as the case may be) to the longitudinal support member 58 or 60. The base plate 90 has an aperture (not shown) defined at each corner thereof for receiving a threaded stud 92 projecting from a steel connector plate 94 welded to each of the longitudinal support members 58 and 60.

During installation of the snow guard device 30 onto the sloped roof 32, each post 82, 84 is anchored to the longitudinal support members 58, 60 mounted to roof substructure 36 by mounting the base plate 90 of each post 82, 84 to the connector plate 94 of each longitudinal support member 58, 60 such that the apertures of the base plate 90 are aligned with the threaded studs 92 projecting from the connector plate 94. The base plate 90 and connector plate 94 are then securely fastened to each other with threaded nuts 96. Anchoring the support means 74 to the roof substructure 36 in the manner described above tends to ensure that the snow guard device 30 will be able to withstand substantial snow loads without the latter being torn off from the roof decking 34.

Generally, circular cutouts (not shown) in the roof panels 38 and 42 allow the posts 82 and 84 to project therethrough, above the roof decking 34. Preferably, the posts 82, 84 are mounted to extend substantially perpendicularly of the roof decking 34 (and of the roof substructure 36), as shown in FIG. 4. It will be appreciated that this need not be the case in every installation. For instance, in other embodiments, the posts could be positioned to extend vertically of the roof decking 34. Alternatively, the posts could be mounted in generally skewed relation to the roof decking 34.

With reference to FIG. 4, a roof flashing device 98 is operatively connected in surrounding relation to each post 82, 84, and securely anchored to the roof panel 38, 42 (as the case may be) to prevent moisture from penetrating below the roof decking 34 into the roof substructure 36. As the roof flashing device 98 does not form part of the invention described herein, it will be described below in broad terms only to permit understanding of its general structure and function. As best shown in FIG. 4, each roof flashing device 98 includes: a resilient, flexible sleeve 100 sized to fit over, and surround, an exterior surface 102 of the post 82, 84; an upper sealing member 104 for maintaining sealing contact with the exterior surface 102 at least one location along the post 82, 84; a lower sealing member 106 for maintaining sealing contact with the roof decking 34 and with the exterior surface 102 at another location along the post 82, 84; and anchoring means 108 (best seen on FIG. 3) for securing the sleeve 100 to the roof decking 34.

As shown in FIG. 3, the posts 82 and 84 are transversely spaced from each other to provide proper support for the rail means 76 mounted thereon. In the preferred embodiment, the posts are transversely spaced from each other a distance of 48 inches, measured centre-to-centre. In installations where the snow guard device 30 is expected to bear large snow loads, it may be advantageous to have the posts mounted in closer proximity one to the other. While, it will be appreciated that the spacing of the posts may be varied as necessary, preferably, the posts should be spaced as far apart from each other as possible so as to minimize the number of support means which will be required for a given expanse of roof decking thereby minimizing cost of the installation. This is also advantageous because, by extension, it also minimizes the number of cutouts required in the roof panels, thereby reducing the likelihood of moisture infiltrating into the roof substructure 36.

Referring to FIGS. 3 and 5, the rail means 76 includes a plurality of rail members 110, 112 and 114. Each rail member 110, 112 and 114 spans adjacent posts. For instance, the rail member 112 extends between the posts 82 and 84. Similarly, the rail member 110 is carried between the post 82 and an adjacent post (not shown). Each rail member 110, 112 and 114 is mounted transversely of the standing seams 48 and in vertically spaced relation to the roof decking 34. The rail member 110, 112, 114 is preferably an aluminum pipe having a length generally corresponding to the transverse spacing between adjacent posts. In the preferred embodiment shown in FIG. 3, the rail member 112 mounted between the posts 82 and 84 measures 48 inches in length. In an alternative embodiment, the rail members could have non-circular cross-sections, for instance, square cross-sections or the like.

Figure 6:
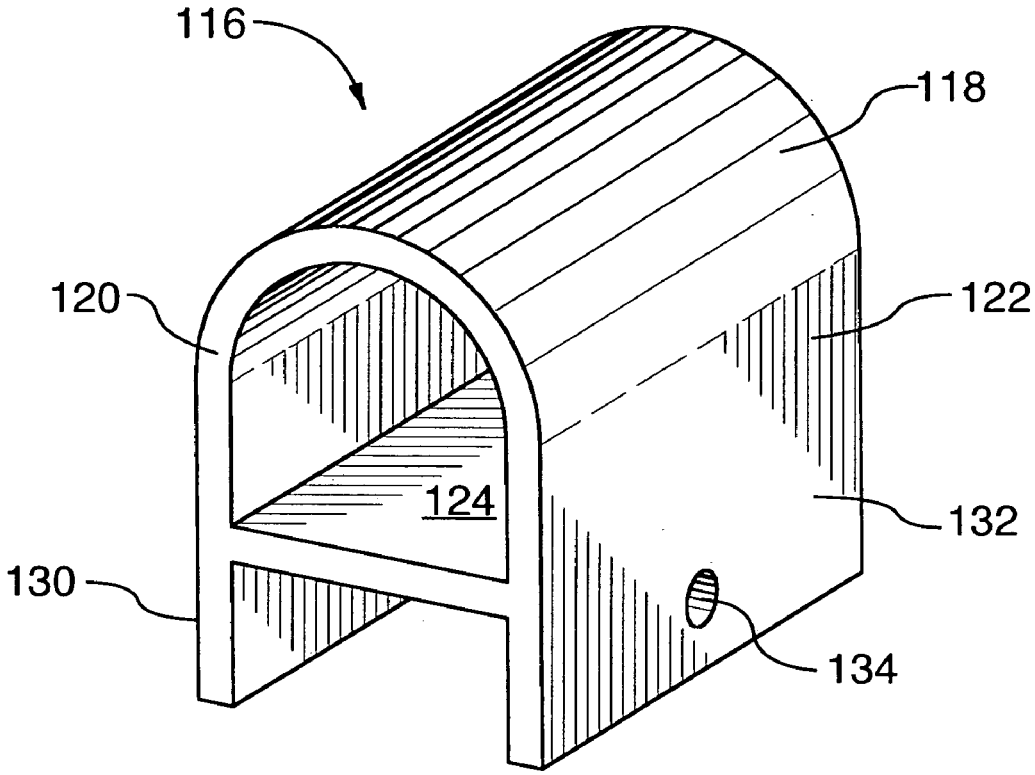
FIG. 6 is an isolated perspective view of a connector for attaching a rail member to a support post shown in FIG. 1.
Figure 7:
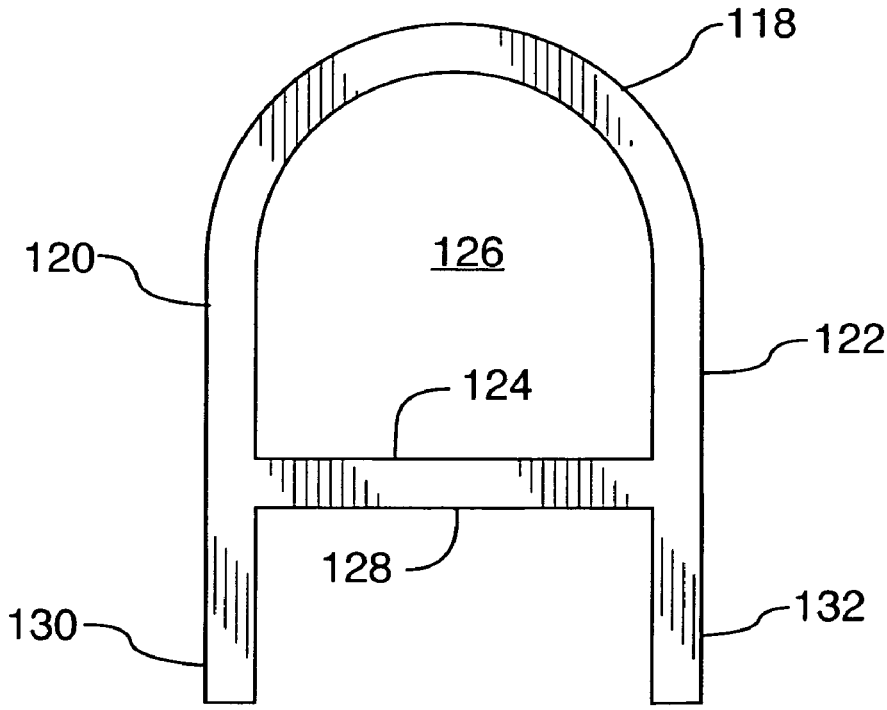
FIG. 7 is a side elevational view of the connector shown in FIG. 6.

Attachment of the rail means 76 to the support means 74 will now be described with specific reference to the rail member 112 and the posts 82 and 84. As the rail members 110 and 114 are similarly attached to their respective posts, no further description will be necessary. The rail member 110 is firmly secured to the top ends 88 of the posts 82 and 84 by way of fastening means 116. Referring to FIGS. 6 and 7, the fastening means 116 includes an inverted, generally U-shaped connector 118 having a pair of spaced apart arms 120 and 122 with a transverse member 124 extending therebetween. The transverse member 124 and the arms 120 and 122 co-operate with each other to define a passageway 126 which is adapted to receive an end of rail member 112 therethrough in substantial close-fitting contact. The transverse member 124 has a generally planar face 128 directed opposite the passageway 126, for abutting the top end 88 of the post 82, 84. Extending downwardly from arms 120 and 122, beyond the planar face 128, are flanges 130 and 132, respectively, for fastening to the top end 88 of the post 82, 84. Each flange 130, 132 is provided with an aperture 134 for alignment with a corresponding aperture (not shown) formed in the top end of the post 82, 84. Fasteners in the nature of nuts 138 and bolts 140 are used to fasten the flanges 130 and 132 of the connector 118 to the top ends 88 of the posts 82 and 84.

During installation of the snow guard device 30, each end of the rail member 112 is inserted into the passageway 126 of its respective connector 118. Each connector 118 is then positioned atop each post 82, 84 such that its planar face 128 abuts the top end of the post 82, 84. Care is taken to align the apertures 134 formed in the flanges 130 and 132 of the connector 118, with the corresponding apertures formed in the top end of the post 82,84. The bolt 140 is then introduced through the aligned apertures and secured in position by the nut 138.

While in the preferred embodiment, attachment of the connector 118 to the post 82, 84 is achieved with a nut and bolt fastener, it will be appreciated that other means of attachment are possible. For instance, in an alternative embodiment, the top ends of the posts could be provided with threading. Similarly, the bottom portion of the connector could be configured to have corresponding threading to allow the connector to be threadably engageable with the top ends of the posts.

The rail member 112 and the connector 118 may be provided with means for preventing rotation of the rail member 112 relative to the connector 118. This may be achieved in a number of ways. For example, it may be possible to adapt the ends of the rail member and the interior surface of the connector defining the passageway, to allow threaded engagement of one with the other. Alternatively, the rail member and the connector could be provided with corresponding apertures. During installation, these apertures could be aligned to receive a pin or bolt therethrough. The pin would operate to lock the rail member into position relative to the connector.

Additionally, while the preferred embodiment employs a connector 118 of the type described above, it will be appreciated that other types of connectors could be used to fasten the rail member 112 to the posts 82 and 84. For instance, a T-shaped connector could be employed. Such a connector would receive the top end of the post through its bottom leg. The opposed, transverse legs of the T-shaped connector would each receive an end of a rail member. Attachment of the connector to rail members and the post could be achieved by way of nut and bolt fastener or by adapting the various elements to allow for threaded engagement therebetween.

As shown in FIGS. 3 and 5, the bracket means 78 includes a plurality of pairs of, transversely spaced, mounting brackets for carrying the snow barrier means 80 therebetween, and for attachment to the rail means 76. More specifically, there is a first pair 141 of brackets centred about the post 82, a second pair 142 of brackets centred about the post 84, and a third pair 143 of brackets positioned between the posts 82 and 84. The pairs 141, 142 and 143 of brackets are transversely spaced from each other and are each positioned between a pair of adjacent standing seams 48. The first pair 141 of brackets is attached to the rail members 110 and 112; the second pair 142 of brackets is fastened to the rail members 112 and 114; and the third pair 143 of brackets is attached to the rail member 112.

As best shown in FIGS. 1 and 4, when operatively mounted to their respective rail members 110, 112 and/or 114 (as the case may be), each pair 141, 142 and 143 of brackets extends upslope and substantially downwardly toward the roof decking 34. Orienting the pairs 141, 142 and 143 in this manner ensures that the snow barrier means 80 will be carried relatively higher on the slope of the roof decking 34 than the posts 82 and 84. This is advantageous because it tends to prevent significant accumulations of snow around the posts 82 and 84, thereby reducing the likelihood that moisture will penetrate into the roof substructure 36 through the cutouts (not shown) provided in the roof panels 38 and 42. Moreover, as will be explained in detail below, the orientation of the pairs 141, 142, and 143 of brackets also tends to enhance stability of the snow guard device 30 on the roof decking 34.

Figure 8:
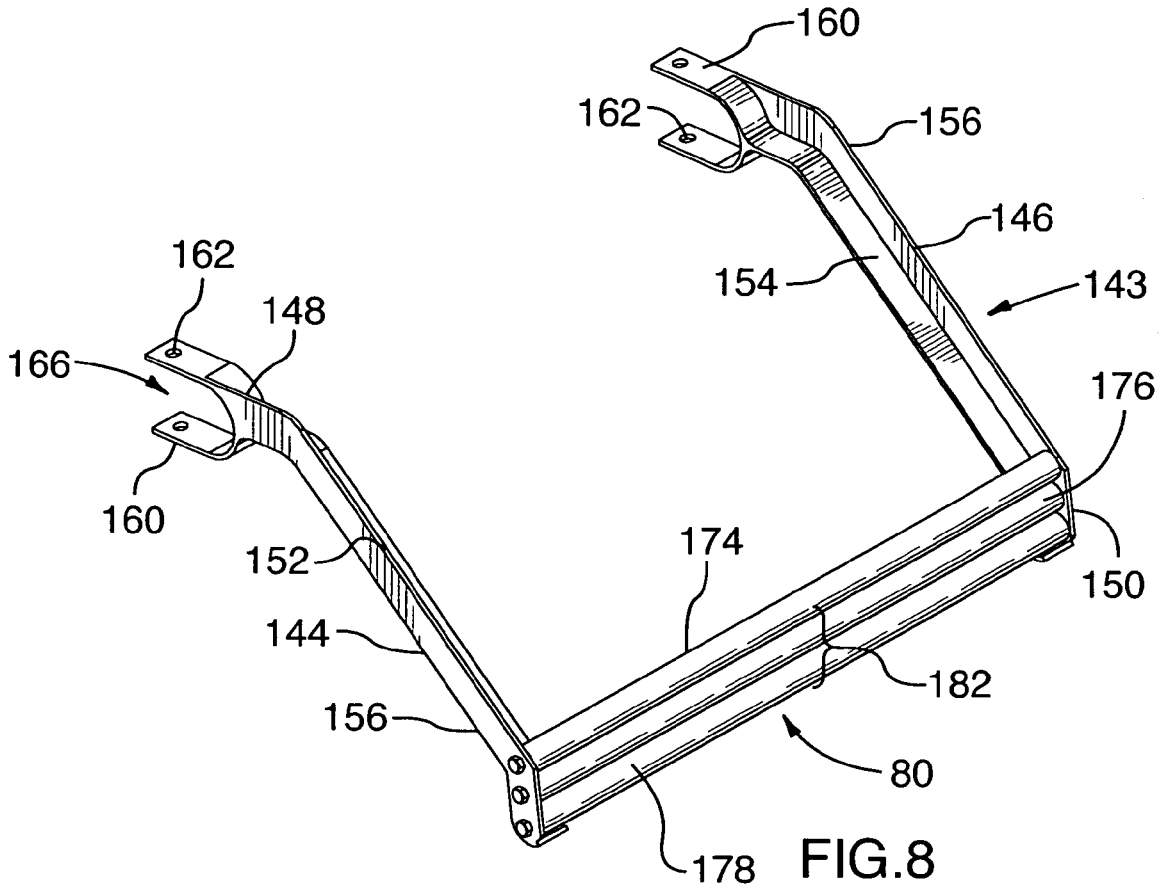
FIG. 8 is an isolated perspective view of a pair of mounting brackets carrying snow barrier members shown in FIG. 1.
Figure 9:
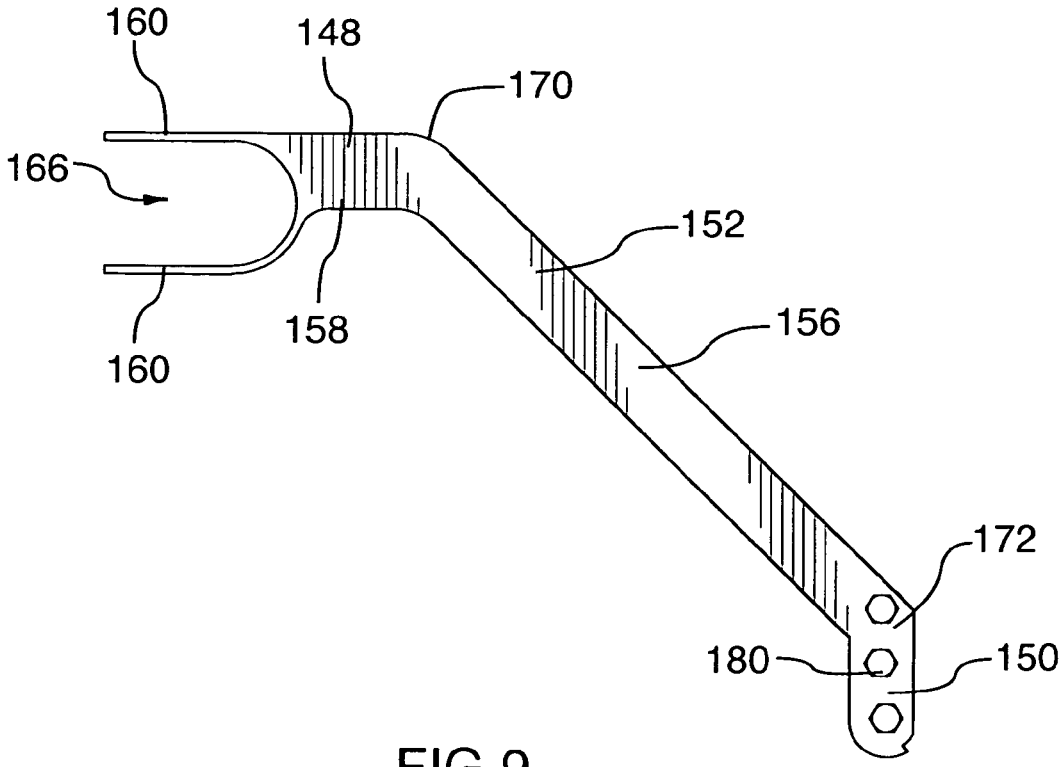
FIG. 9 is a side elevational view of the mounting brackets and snow barrier members shown in FIG. 8.

Since the first, second and third pairs 141, 142 and 143, respectively, are identical to each other it will suffice to describe only one representative pair of brackets, being the third pair 143. Referring now to FIGS. 8 and 9, there is shown brackets 144 and 146 of the third pair 143 of brackets. Each bracket 144,146 has a proximal portion 148 for attaching to the rail member 110, a distal portion 150 for abutting the roof decking 34, and a generally straight, intermediate portion 152 joining the proximal portion 148 to the distal portion 150. Each bracket 144, 146 further includes a flange member 154 reinforced by a transverse web member 156, which extends substantially between the proximal and distal portions 148 and 150 thereof. Preferably, the brackets 144 and 146 are formed of aluminum.

The flange member 154 has a generally U-shaped, forked end 158 at the proximal portion 148. The forked end 158 is provided with a pair of prongs 160, each having an aperture 162 defined therein for receiving a threaded bolt 164 therethrough. The prongs 160 co-operate with each other to define a clevis 166 for fastening engagement with the rail member 110. To secure the bracket 144, 146 to the rail member 110, the proximal portion 148 of the bracket 144, 146 is positioned such that the rail member 110 is received between the prongs 160. The threaded bolt 164 (shown on FIG. 4) is passed through the apertures 162 formed in the prongs 160 and then fastened with a threaded nut 168 (shown in FIG. 1). The rail member 110 is thus retained captively between the prongs 160. While in the preferred embodiment, the clevis 166 is used to attach the bracket 144, 146 to the rail member 110, it will be appreciated that other types of fasteners could also used.

As best shown in FIG. 9, the bracket 144, 146 has a generally doglegged profile defined by a first bend 170 formed therein at the juncture between the proximal portion 148 and the intermediate portion 152, and a second bend, 172 formed therein at the juncture between the intermediate portion 152 and the distal portion 150. As will be explained in detail below, the bracket 144, 146 is configured in this manner to facilitate proper orientation of the snow barrier means 80 relative to the roof decking 34.

In the preferred embodiment, three, substantially vertically spaced, snow barrier members in the nature of elongate cross-beams 174, 176 and 178 define the snow barrier means 80. It will, however, be appreciated that in an alternate embodiment additional cross-beams could be employed. Alternatively, the barrier means could be formed of a single cross-beam.

Each cross-beam 174, 176, 178 is fixedly secured to the web members 156 of brackets 144 and 146 at the distal portions 150 thereof by threaded fasteners 180. While in the preferred embodiment, the brackets 144 and 146 and the cross-beams 174, 176 and 178 are fabricated as separate parts requiring assembly during installation of the snow guard device 30, in an alternative embodiment, the brackets may be integrally formed with the cross-beams.

The cross-beams 174, 176 and 178 are sized to correspond substantially to the transverse spacing between a pair of adjacent elongate corrugations 52. In the preferred embodiment, each cross-beam 174, 176, 178 measures 18.5 inches and is formed from aluminum pipe having an outside diameter of 0.75 inches. It will, however, be appreciated that the cross-beams need not be straight pipe sections nor have circular cross-sections. In other embodiments, cross-beams formed of non-linear pipe sections or cross-beams having non-circular cross-sections could be used to similar advantage.

Referring to FIGS. 4 and 9, the cross-beams 174, 176 and 178 co-operate with each other to define a substantially planar face 182 for abutting snow. The snow abutting face 182 is directed away from the guide means 76. In the preferred embodiment, the snow abutting face 182 is oriented substantially perpendicular to the roof decking 34 to effectively restrain the snow or ice from sliding down the pitch of the roof surface 32. This is made possible by the doglegged profile of the brackets 144 and 146 defined, in part, by the second bend 172. Orienting the snow abutting face 182 in this manner is particularly advantageous. When snow accumulates on the roof decking 34, the snow load bearing against the snow abutting face 182 generates a torque thereon which causes the distal portions 150 of the brackets 144 and 146 to bear firmly against the roof decking 34, thereby imparting added stability to the snow guard device 30.

Figure 10:
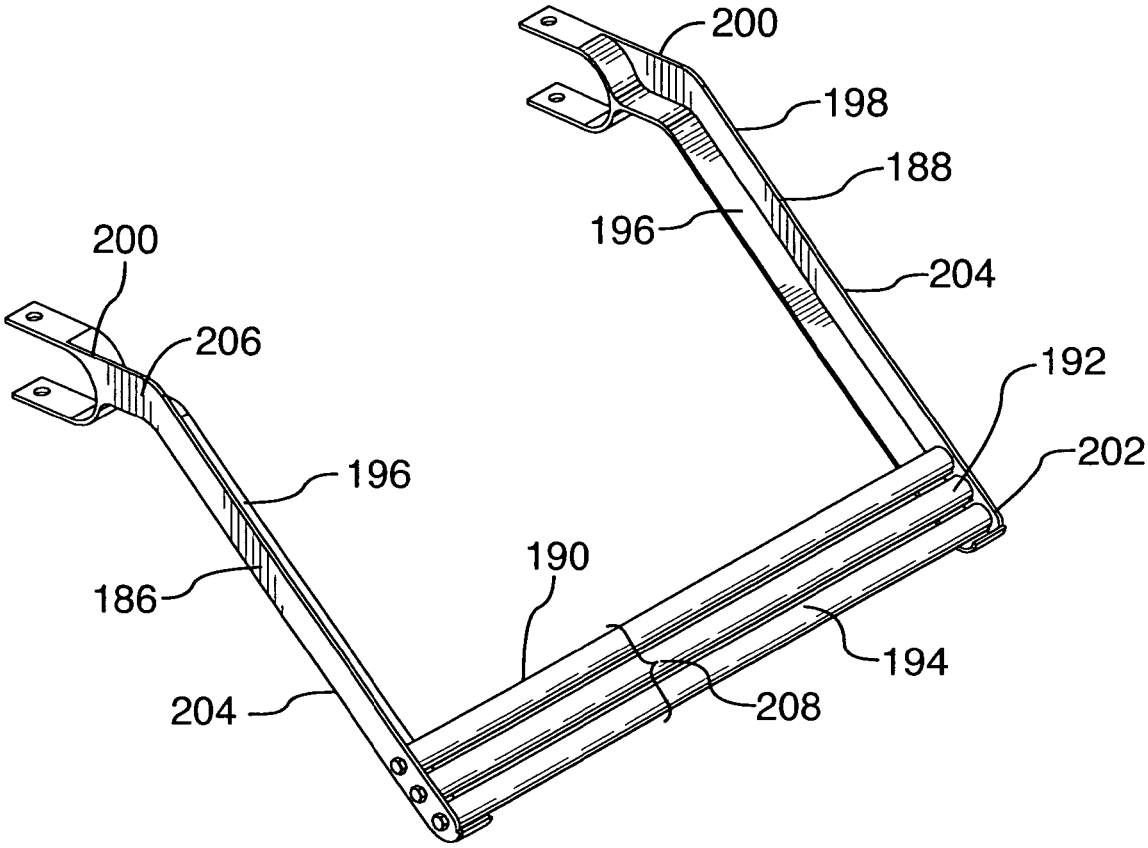
FIG. 10 is an isolated perspective view of an alternative embodiment of the mounting brackets and snow barrier members shown in FIG. 8.
Figure 11:
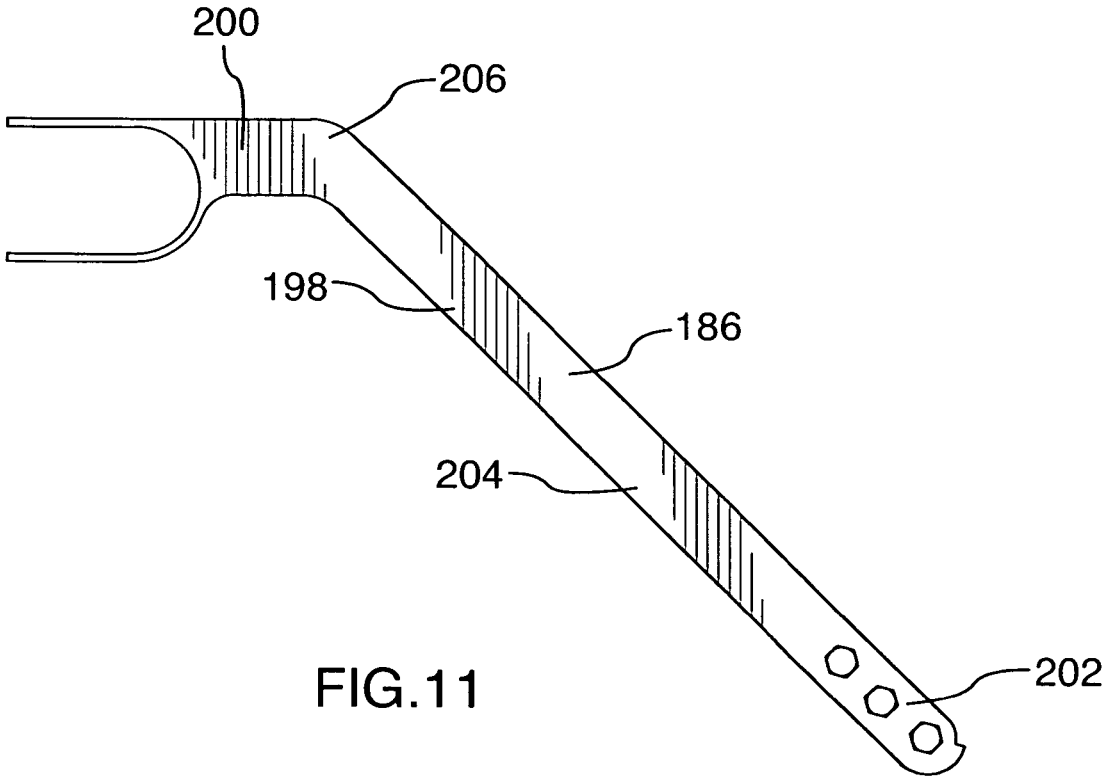
FIG. 11 is a side elevational view of the mounting brackets and snow barrier members shown in FIG. 10.

While it is preferred that the snow bearing face 182 defined by the cross-beams 174, 176 and 178 be oriented substantially perpendicular of the roof decking 34, in alternative embodiments, the snow bearing face may be oriented in a non-perpendicular fashion. One such alternative embodiment is shown in FIGS. 10 and 11, where a pair of brackets 186 and 188 carries a plurality of snow barrier members in the nature of cross-beams 190, 192 and 194. The brackets 186 and 188 generally resemble brackets 144 and 146. More specifically, each bracket 186, 188 includes a flange member 196 reinforced by a web member 198. Each bracket 186, 188 further has a proximal portion 200, a distal portion 202, and an intermediate portion 204 joining the proximal portion 200 to the distal portion 202.

However, the brackets 186 and 188 differ from the brackets 144 and 146, in that the brackets 186 and 188 only have a single bend 206, which defines their generally doglegged profile. The bend 206 is formed in each bracket 186 and 188 at the juncture between the proximal portion 200 and the intermediate portion 204 thereof. There is no bend at the juncture between the intermediate portion 204 and the distal portion 202 such that the former portion linearly transitions into the latter portion. As a result, the cross-beams 190,192 and 194 are disposed at the distal portions 202 of the brackets 186 and 188 in a substantially diagonal arrangement. The cross-beams 190, 192 and 194 co-operate with each other to define a generally planar, snow abutting face 208, which, due to the modified configuration of brackets 186 and 188, has a generally skewed orientation relative to the roof decking 34.

Figure 12:
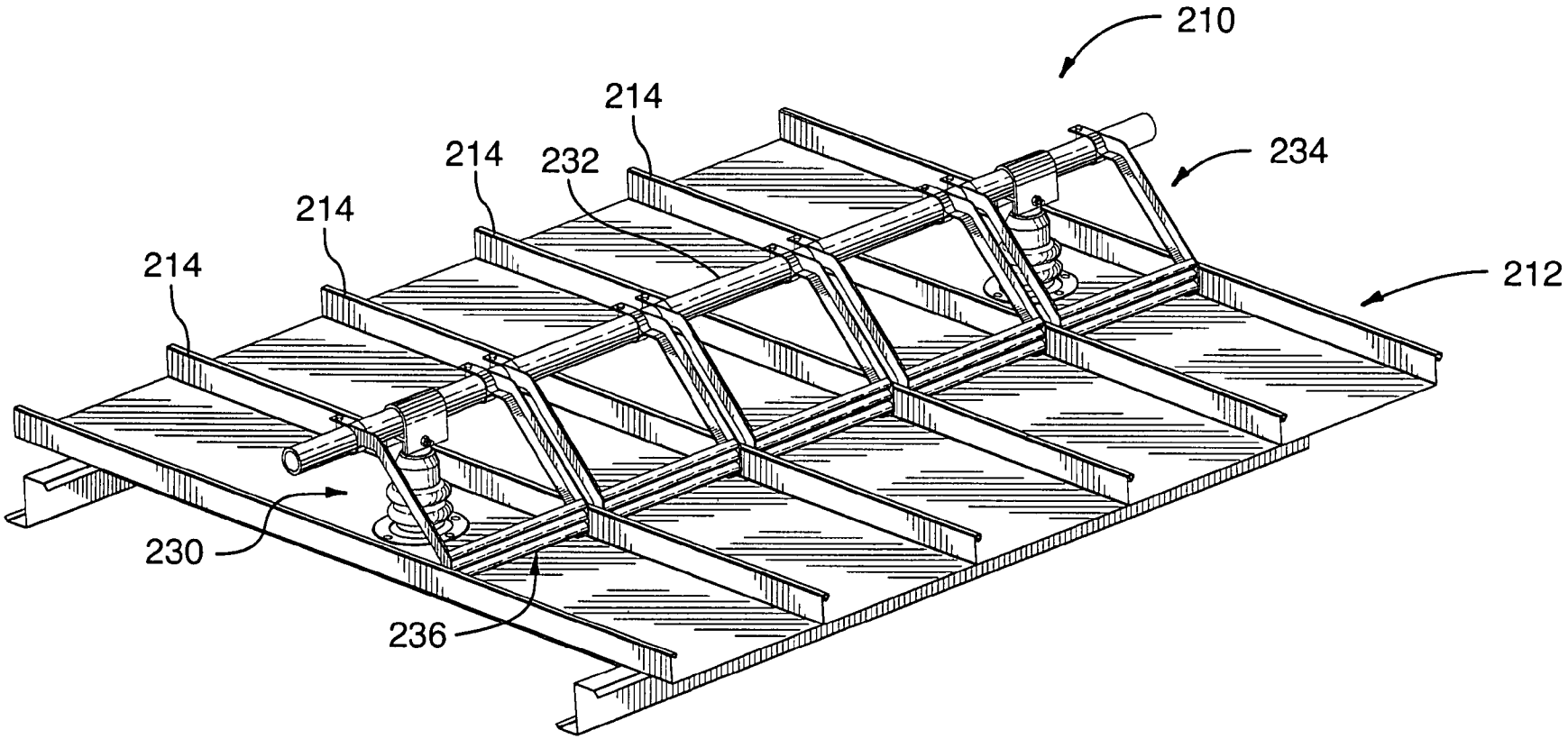
FIG. 12 is a rear, right perspective view of a snow guard device according to an alternate embodiment to that illustrated in FIG. 1, showing the snow guard device operatively mounted onto a second type of sloped roof surface.

In the preferred embodiment, the snow guard device 30 is shown installed onto a first type of sloped roof surface having a plurality of elongate standing seams 48 and corrugations 52. It will be appreciated that the snow guard device may be also be used on other types of sloped roof surfaces. For instance, in an alternative embodiment shown in FIGS. 12, 13 and 14, a snow guard device designated generally with reference numeral 210, is shown operatively connected onto a sloped roof decking 212 having a plurality of standing seams 214, but no corrugations. The roof decking 212 includes a plurality of elongate roof panels 216, 218, 220, 222 and 224, each measuring 15 inches wide, arranged side-by-side. Each roof panel has raised, upwardly extending longitudinal edges 226 and 228. Adjoining roof panels 216 and 218, 218 and 220, 220 and 222, and 222 and 224, abut along their respective raised edges 226 and 228. During assembly of the roof decking 212, the abutting raised edges 226 and 228 of the adjoining roof panels are crimped to form the standing seam 214 of the single-lock type. The standing seams 214 extend in a direction substantially parallel to the slope of the roof decking 212. In this embodiment, the standing seams 214 are transversely spaced from each other a distance of 15 inches. A roof decking system such as the one described above is available from Butler Manufacturing Company of Kansas City, Mo. It is known as the VSR™ Roof System.

The snow guard device 210 generally resembles the snow guard device 30 in that it includes support means 230, longitudinal support means (not visible in FIGS. 12 and 13), rail means 232, bracket means 234 and snow barrier means 236 with all the foregoing elements being installed in substantially the same manner as their counterpart elements described earlier in the context of the preferred embodiment.

The support means 230 are generally similar to the support means 74 of the preferred embodiment in that the former means 230 includes a pair of transversely spaced, posts 238 and 240 (best shown on FIG. 13) similar to posts 82 and 84. However, in this embodiment, the spacing between the posts 238 and 240 is 60 inches. The posts 238 and 240 are mounted to longitudinal support members, 231 and 233 which in turn are mounted to substructure 36 in the same manner as posts 82 and 84, are mounted to longitudinal support members 58 and 60.

The rail means 232 includes rail members 242, 244 and 246 which are generally similar to rail members 110, 112 and 114, but for their length. The rail member 244 mounted between the posts 238 and 240 measures 60 inches in length.

Figure 13:
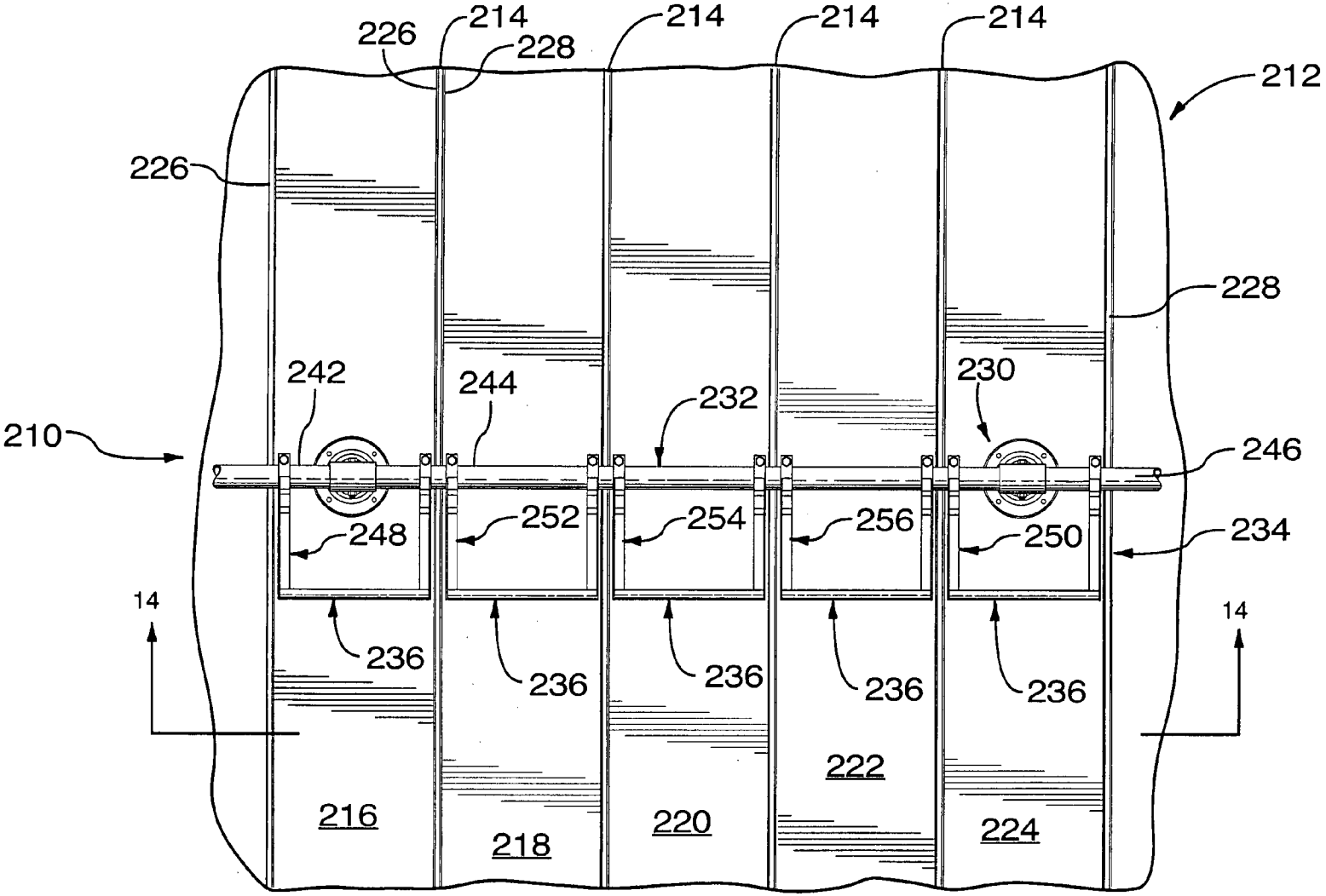
FIG. 13 is a top plan view of the snow guard device shown in FIG. 12.

With specific reference to FIG. 13, the bracket means 234 includes a first pair 248 of brackets centred about the post 238, a second pair 250 of brackets centred about the post 240, and third, fourth, and fifth pairs of brackets, designated respectively, with reference numerals, 252, 254 and 256, mounted between the posts 238 and 240. Rail members 242 and 244 support the first pair 248 of brackets. The second pair 250 is mounted to the rail members 244 and 246. The third, fourth and fifth pairs 252, 254 and 256 are attached to the rail member 244. The pairs 248, 250, 252, 254, and 256 are transversely spaced from each other and are positioned between a pair of adjacent standing seams 214. Each pair 248, 250, 252, 254, and 256 is oriented in a similar fashion to the pairs 141, 142, and 143 of the preferred embodiment. That is, each pair extends upslope and substantially downwardly toward the roof decking 214. Moreover, each pair 248, 250, 252, 254, 256 includes brackets 257 and 258, which are generally similar to the brackets 144 and 146 of the preferred embodiment.

Figure 14:
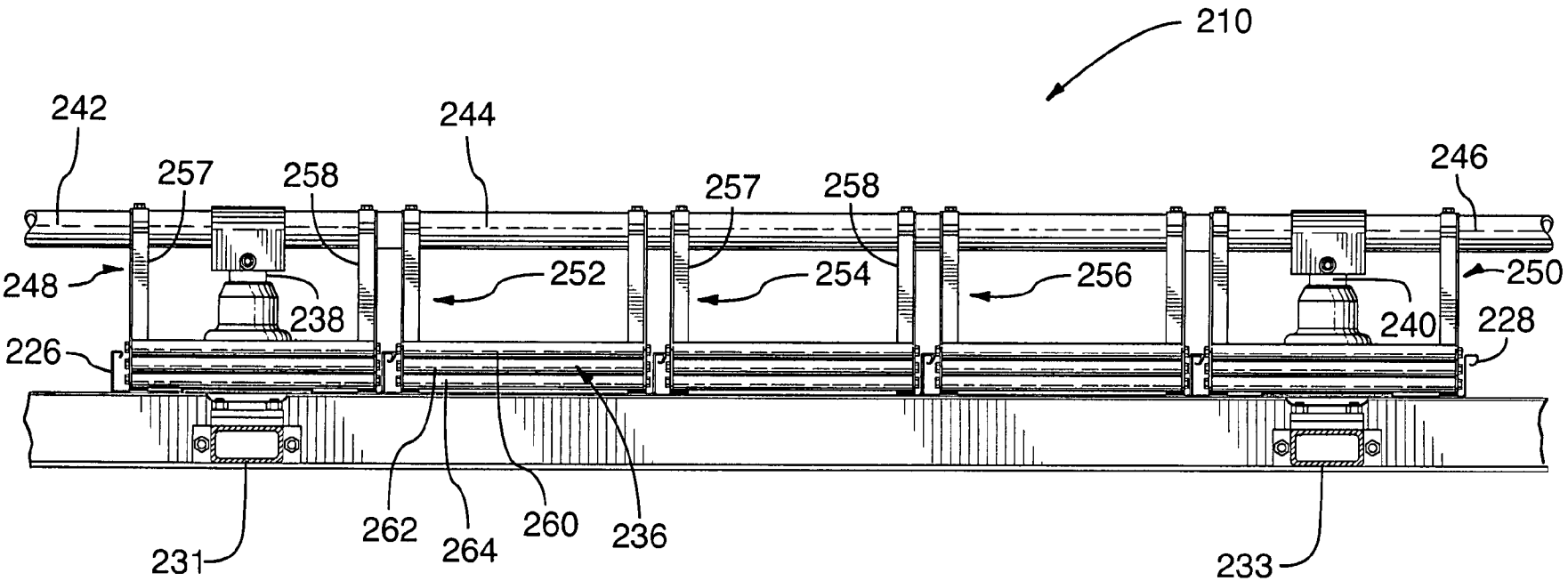
FIG. 14 is a cross-sectional view of the snow guard device shown in FIG. 13 taken along section '14—14' thereof.

Referring to FIG. 14, the snow barrier means 236 generally resembles the snow barrier means 80 of the preferred embodiment in that it includes three, vertically-spaced, cross-beams 260, 262 and 264 oriented in similar fashion to the cross-beams 174, 176 and 178. However, the cross-beams 260, 262 and 264 differ from their counterparts 174, 176 and 178 in that they are sized to correspond substantially to the transverse spacing between a pair of adjacent standing seams 214. In contrast, as described above, the cross-beams 174, 176 and 178 of the preferred embodiment are sized to correspond substantially to the transverse spacing between adjacent elongate corrugations 52 (which spacing is less than the spacing between the standing seams 48).

Figure 15:
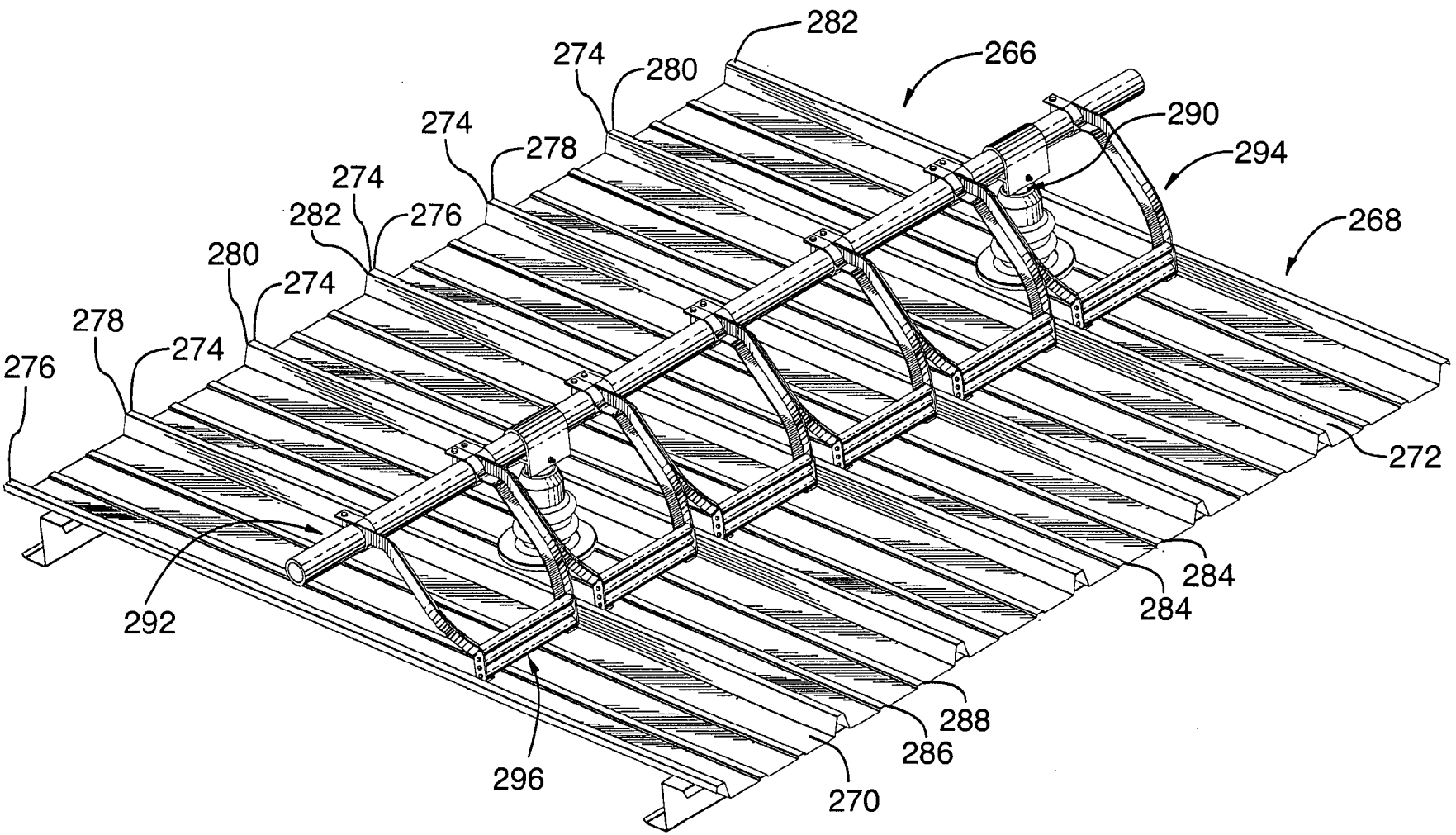
FIG. 15 is a rear, right perspective view of a snow guard device according to an alternate embodiment to that illustrated in FIG. 1, showing the snow guard device operatively mounted onto a third type of sloped roof surface.

In another alternative embodiment shown in FIGS. 15 to 20, a snow guard device generally designated with reference numeral 266, is shown operatively connected onto a third type of sloped roof surface decking 268 having a plurality of corrugations, but no standing seams. The roof decking 268 includes two elongate roof panels 270 and 272, each measuring 36 inches wide, mounted side-by-side. Each roof panel 270, 272 has a first set of elongate corrugations 274 formed therein defined, in part, by generally trapezoidal-shaped, ridges 276, 278, 280 and 282. The ridges 276, 278, 280 and 282 are transversely spaced from the each other a distance of 12 inches. Disposed between each pair of adjacent ridges 276 and 278, 278 and 280 and 280 and 282, are a second set of corrugations 284 defined, in part, by a pair of generally, trapezoidal-shaped ridges 286 and 288. As best shown in FIG. 15, the first set of corrugations 274 stands higher than the second set of corrugations 284. In this embodiment, the corrugations 274 stand 1.5 inches high.

During assembly of the roof decking 268, the respective ridge 282 of the roof panel 270 is superimposed on the respective ridge 276 of the adjoining panel 272 and the roof panels 270 and 272 are fastened to each other along the superimposed ridges (see FIG. 5). A roof decking system such as the one described above is available from Butler Manufacturing Company of Kansas City, Mo. It is known as the Butlerib II® Roof System.

The snow guard device 266 generally resembles the snow guard device 30 in that it includes support means 290, longitudinal support means (not visible in FIGS. 15, 16), rail means 292, bracket means 294 and snow barrier means 296 with all the foregoing elements being installed in substantially the same manner as their counterpart elements of the preferred embodiment, described earlier.

The support means 290 are generally similar to the support means 74 of the preferred embodiment in that the former means 290 includes a pair of transversely spaced, posts 298 and 300 (shown in FIG. 17) similar to posts 82 and 84. As with the posts 82 and 84, the spacing between the posts 298 and 300 is 48 inches. The positioning of the posts 298 and 300 relative to the roof panels 270 and 272 differs from that of the posts 82 and 84 relative to the roof panels 38 and 42. In the preferred embodiment, both posts 82 and 84 are disposed centrally relative to their respective roof panels 38, 42 (as the case may be). In the alternative embodiment shown in FIG. 16, while the post 298 is mounted centrally in relation to the roof panel 270, the post 300 is mounted eccentrically in relation to the roof panel 272. The posts 298 and 300 are mounted to longitudinal support members 291, 293, which in turn are mounted to the substructure 36, in this same manner as posts 82 and 84 are mounted to longitudinal support members 58 and 60.

The rail means 292 includes rail members 302, 304 and 306, which are generally similar to rail members 110, 112 and 114.

Figure 16:
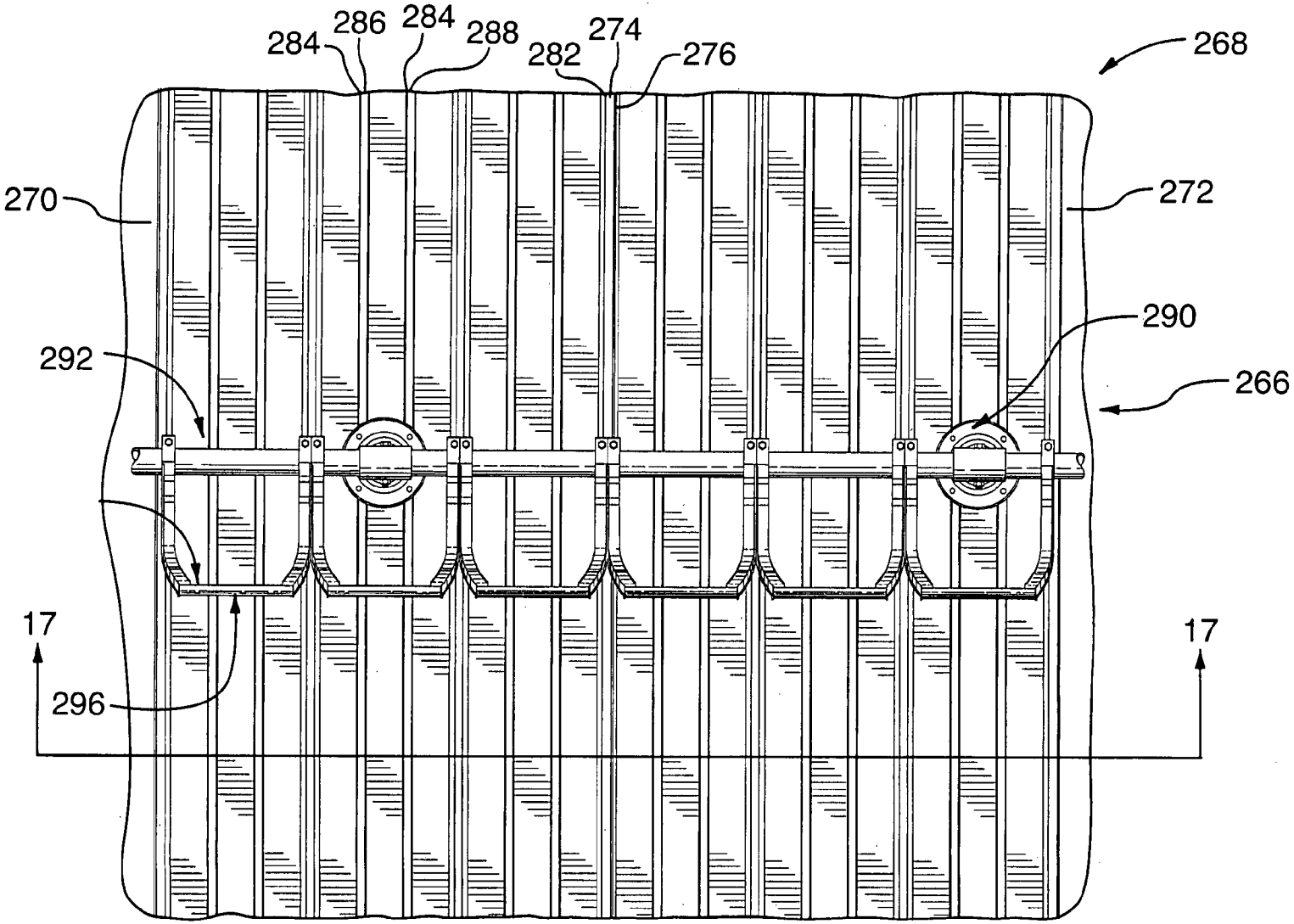
FIG. 16 is a top plan view of the snow guard device shown in FIG. 15.
Figure 17:
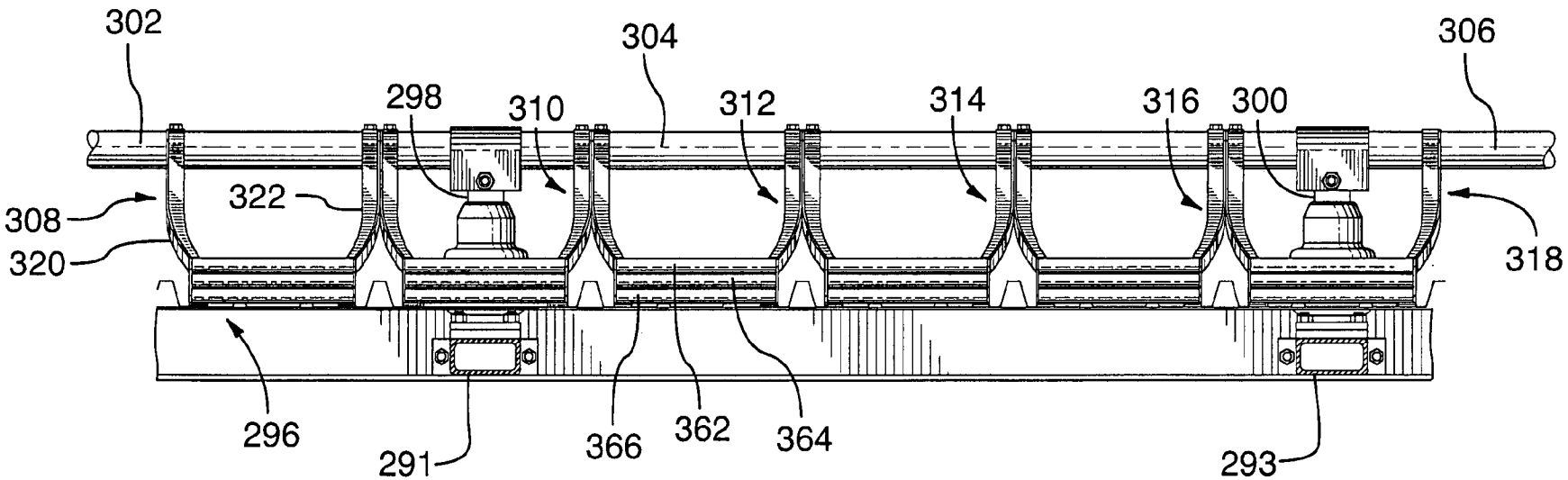
FIG. 17 is a cross-sectional view of the snow guard device shown in FIG. 16 taken along section '17—17' thereof.

As will be explained below the bracket means 294 differs in several respects with the bracket means 76 of the preferred embodiment. Referring to FIG. 16, the bracket means 294 includes a first pair 308 of brackets supported by the post 298 and another post (not shown) and attached to rail member 302; a second pair 310 of brackets centered about the post 298 and mounted between the rail members 302 and 304; third, fourth, and fifth pairs of brackets, designated respectively, with reference numerals, 312, 314 and 316, mounted between the posts 298 and 300 and fastened to the rail member 304; and a sixth pair 318 of brackets centered about the post 300 and supported by rail members 304 and 306. Each pair 308, 310, 312, 314, 316, and 318 is positioned between a pair of adjacent corrugations 274. However, as will be explained in greater detail below, the pairs of brackets are not transversely spaced from each other, but rather are in abutting relation one with the other along a portion thereof. Each pair 308, 310, 312, 314, 316, 318 is oriented in a similar fashion to the pairs 141, 142 and 143 of the preferred embodiment. That is, each pair extends upslope and substantially downwardly toward the roof decking 268.

Figure 18:
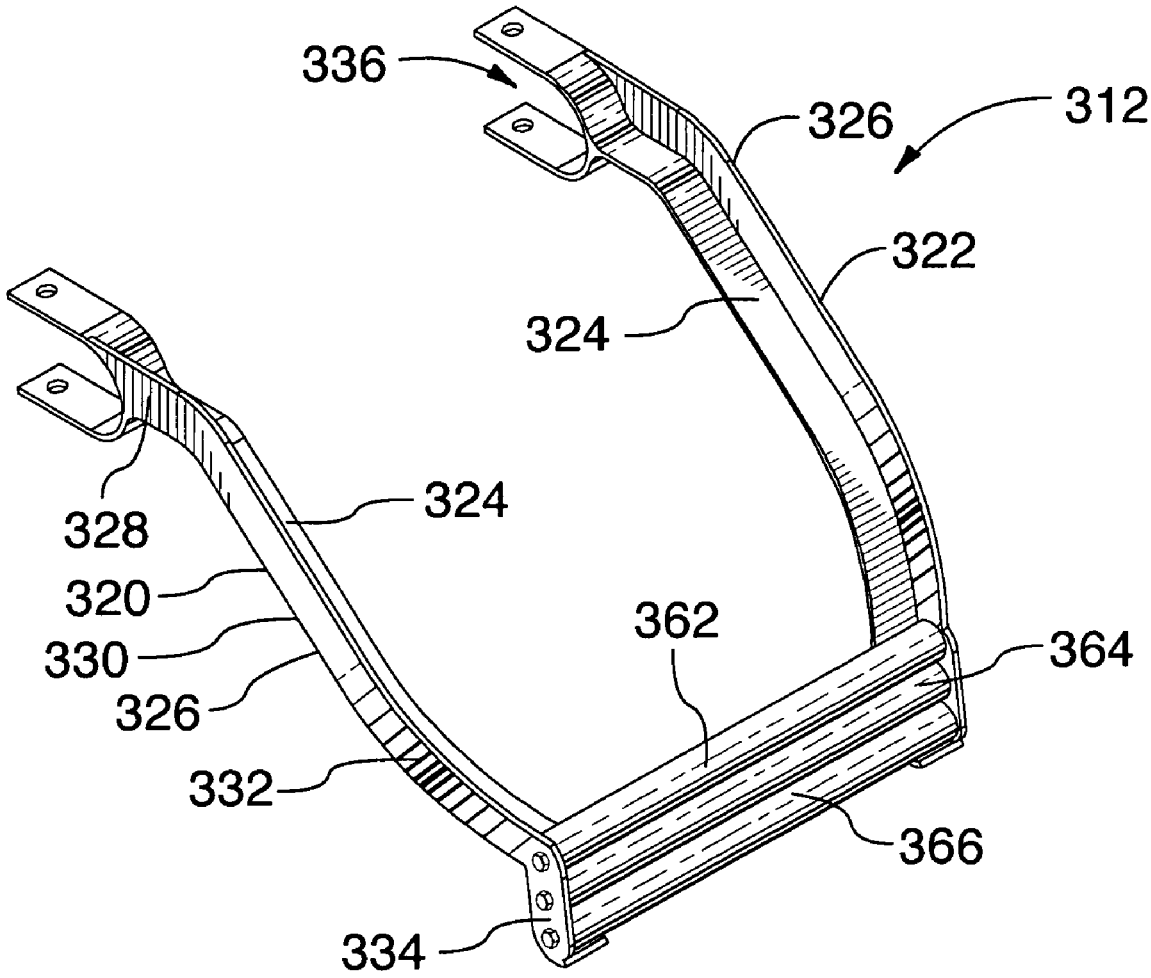
FIG. 18 is an isolated perspective view of a pair of mounting brackets carrying snow barrier members shown in FIG. 15.
Figure 19:
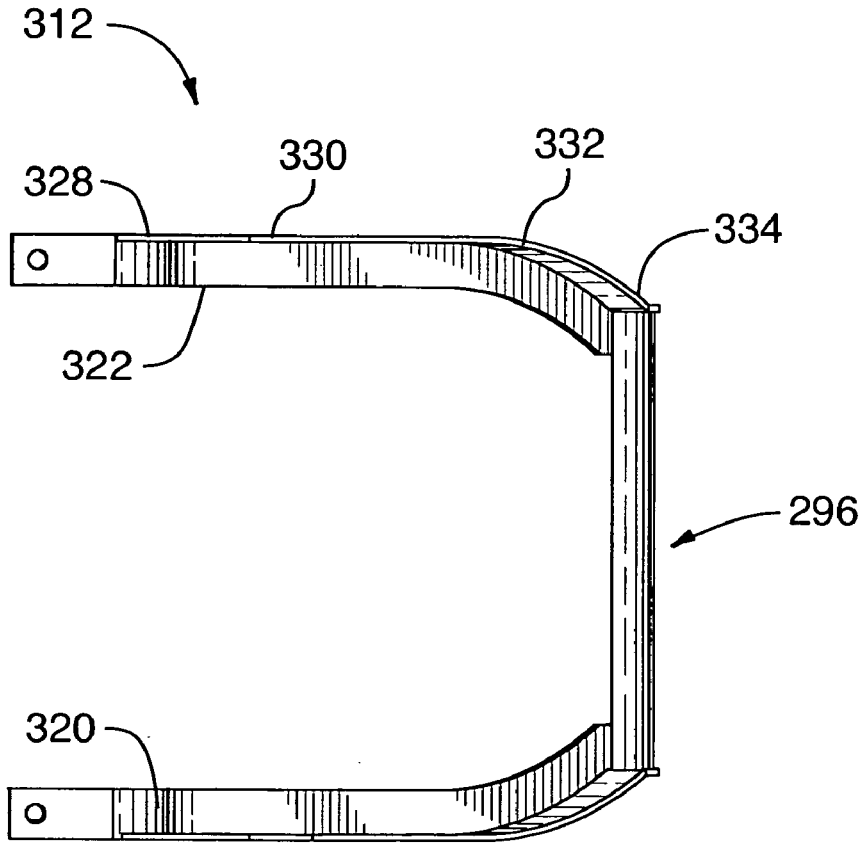
FIG. 19 is a top plan view of the mounting brackets and snow barrier members shown in FIG. 18.
Figure 20:
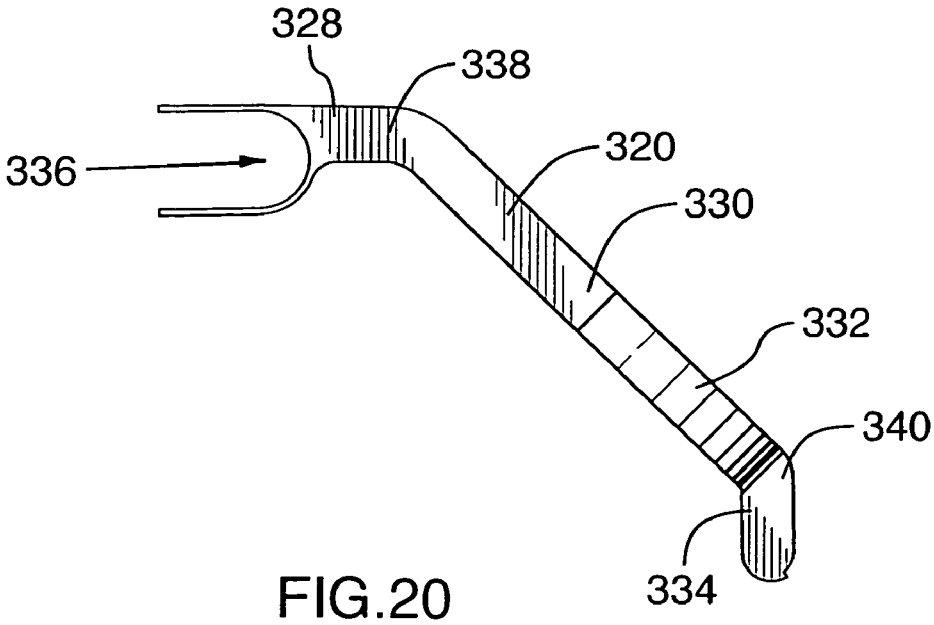
FIG. 20 is a side elevational view of the mounting brackets and snow barrier members shown in FIG. 18.

Since the first, second, third, fourth, fifth and sixth pairs 308, 310, 312, 314, 316 and 318, respectively, are identical to each other it will suffice to describe only one representative pair of brackets—the third pair 312. Referring now to FIGS. 18, 19 and 20, there is shown brackets 320 and 322 of the third pair 312 of brackets. Each bracket 320, 322 includes a flange member 324 reinforced by a transverse web member 326. Each bracket 320, 322 further has a proximal portion 328, a first intermediate straight portion 330, a second intermediate curved portion 332, and a distal portion 334. A clevis 336 similar to clevis 166 of the preferred embodiment is formed in the proximal portion 328 of each bracket 320, 322 for attachment to the rail member 304.

The bracket 320, 322 differs from the bracket 144, 146 in that, in addition to intermediate straight portion 330, it has intermediate curved portion 332 positioned between the proximal and distal portions 328 and 334 thereof. When assembled to the snow barrier means 296, the brackets 320 and 322 are seen to curve inwardly from their respective intermediate portions 330 toward their respective distal portions 334 (as best shown in FIG. 19). Configuring the brackets 320 and 322 in this fashion, allows adjacent pairs of brackets to be placed side-by-side in abutting relation one with the other while still permitting the brackets of a pair to clear a pair of adjacent corrugations 274. For instance, when the snow guard 266 is operatively connected to the roof decking 268, the bracket 320 of the third pair 312 and the bracket 322 of the second pair 310 contacts one another. More specifically, their respective web members 326 abut along their respective portions 328 and 330. Because the spacing between their respective distal ends 334 is less than the spacing between their respective proximal ends 328, the brackets 320 and 322 fit between a pair of adjacent corrugations 274. It will be appreciated that the brackets 320 and 322 may be employed in snow guard devices for use on roof surfaces other than roof decking 268. For instance, with appropriate modifications, these types of brackets could be employed to similar advantage on the roof decking 34 and the roof decking 212 described above.

For certain installations, it may be advantageous to attach abutting brackets of adjacent pairs to each other for enhanced strength and stability. This can be achieved by fastening the abutting web members of the brackets with bolts, screws, or the like. Alternatively, if a more permanent connection is desired, a pair of abutting brackets may be welded to each other or integrally formed one with the other during manufacturing.

As best shown in FIG. 20, each bracket 320, 322 has a doglegged profile that is generally similar to that of bracket 144, 146 of the preferred embodiment. In particular, each bracket 320, 322 has a first bend 338 formed therein at the juncture between the proximal portion 328 and the first intermediate straight portion 330, and a second bend 340 formed therein at the juncture between the second intermediate curved portion 332 and the distal portion 334.

Figure 21:
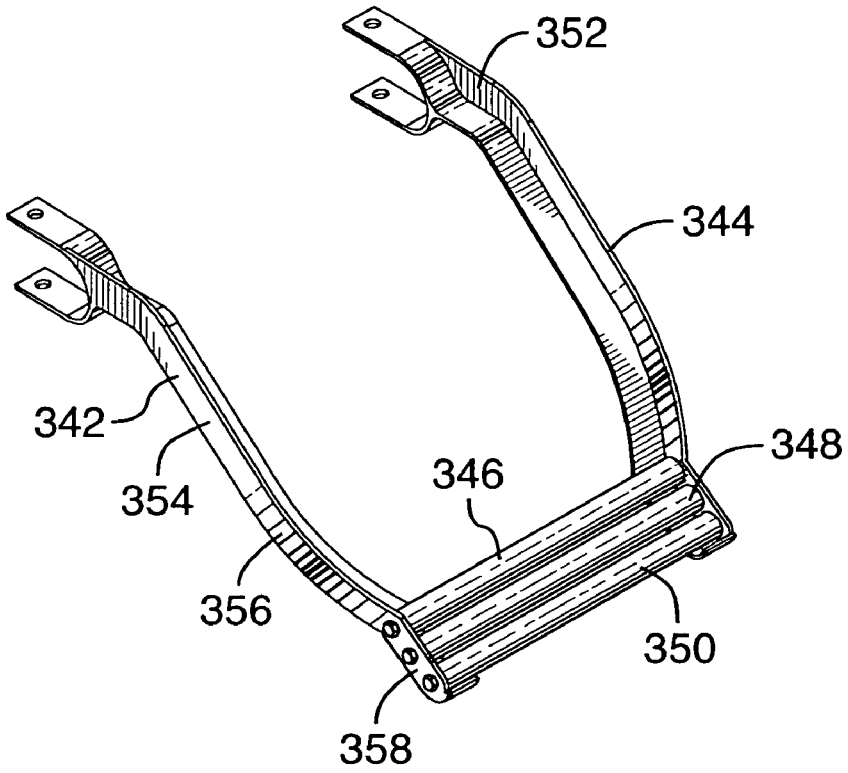
FIG. 21 is an isolated perspective view of an alternative embodiment of the mounting brackets and snow barrier members to those shown in FIG. 18.
Figure 22:
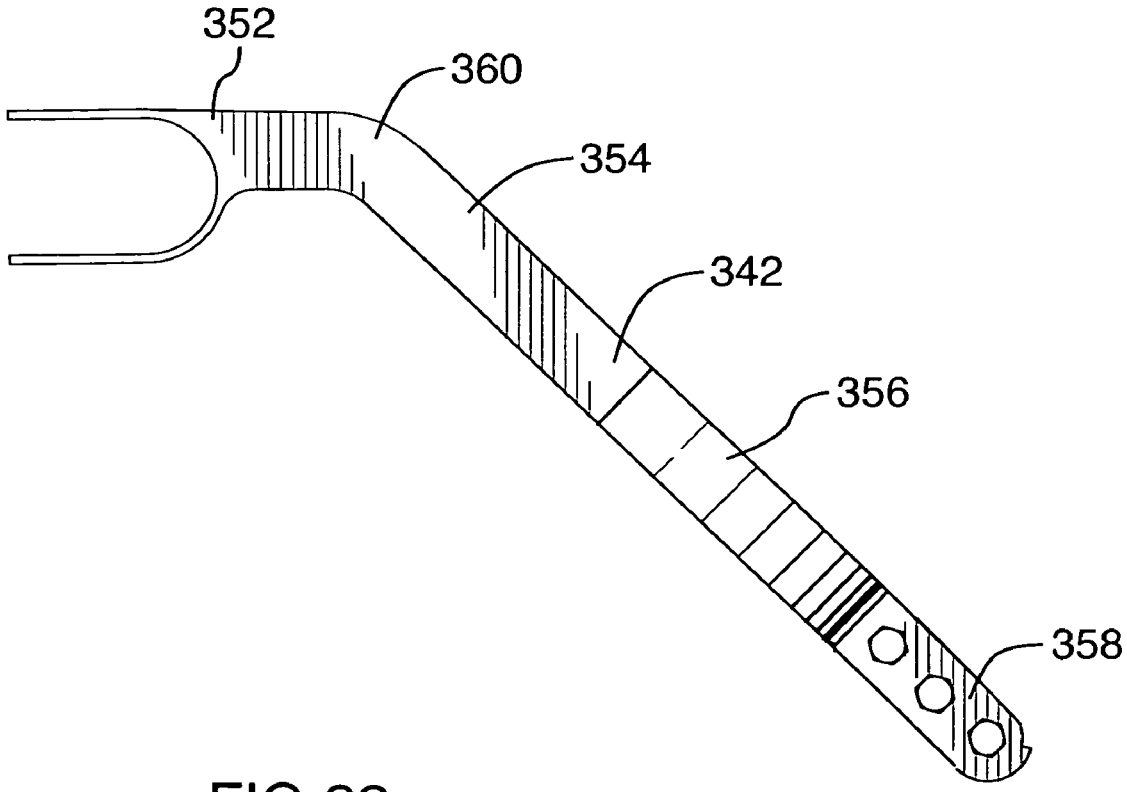
FIG. 22 is a side elevational view of the mounting brackets and snow barrier members shown in FIG. 21.

It will be appreciated that in an alternative embodiment, it may be possible to configure the brackets 320 and 322 to have a single bend formed therein similar to the embodiment shown in FIGS. 10 and 11. An example of such an embodiment is shown in FIGS. 21 and 22, where a pair of brackets are designated with reference numerals 342 and 344 and snow barrier members in the nature of cross-beams are identified with reference numerals 346, 348 and 350, respectively. The brackets 342 and 344 are generally similar to the brackets 186 and 188 shown in FIGS. 10 and 11. Each bracket 342, 344 has a proximal portion 352, a first intermediate straight portion 354, a second intermediate curved portion 356, and a distal portion 358. Each bracket 342, 344 has a generally doglegged profile defined by a single bend 360 formed therein at the juncture between the proximal portion 352 and the first intermediate straight portion 354. In like fashion to the cross-beams 190, 192 and 194 shown in FIGS. 10 and 11, the cross-beams 346,348 and 350 are disposed between the distal portions 358 of the brackets 342 and 344 in a substantially diagonal arrangement.

Referring now to FIGS. 18, 19 and 20, the snow barrier means 296 generally resembles the snow barrier means 80 of the preferred embodiment in that it includes three, vertically-spaced, cross-beams 362, 364 and 366 oriented in similar fashion to the cross-beams 174, 176 and 178. The cross-beams 362, 364 and 366 are sized to correspond substantially to the transverse spacing between a pair of adjacent corrugations 274. In this embodiment, each cross-beam 362, 364, 366 measures approximately 9.4 inches. When the snow guard device 266 is operatively connected to the roof decking 268, the lowermost cross-beam 366 abuts the corrugations 284 formed in the roof panel 270.

Figure 23:
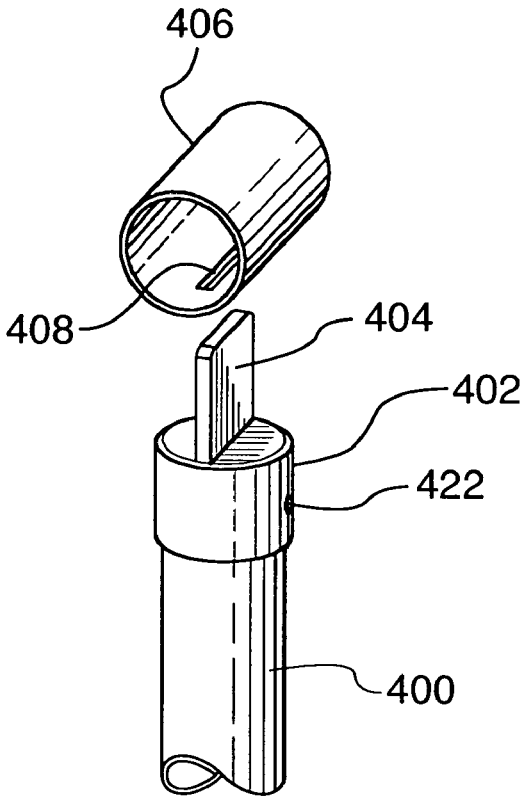
FIG. 23 is an isolated perspective view of an alternative embodiment of the connector and top portion of the support post for attaching a rail member.
Figure 24:
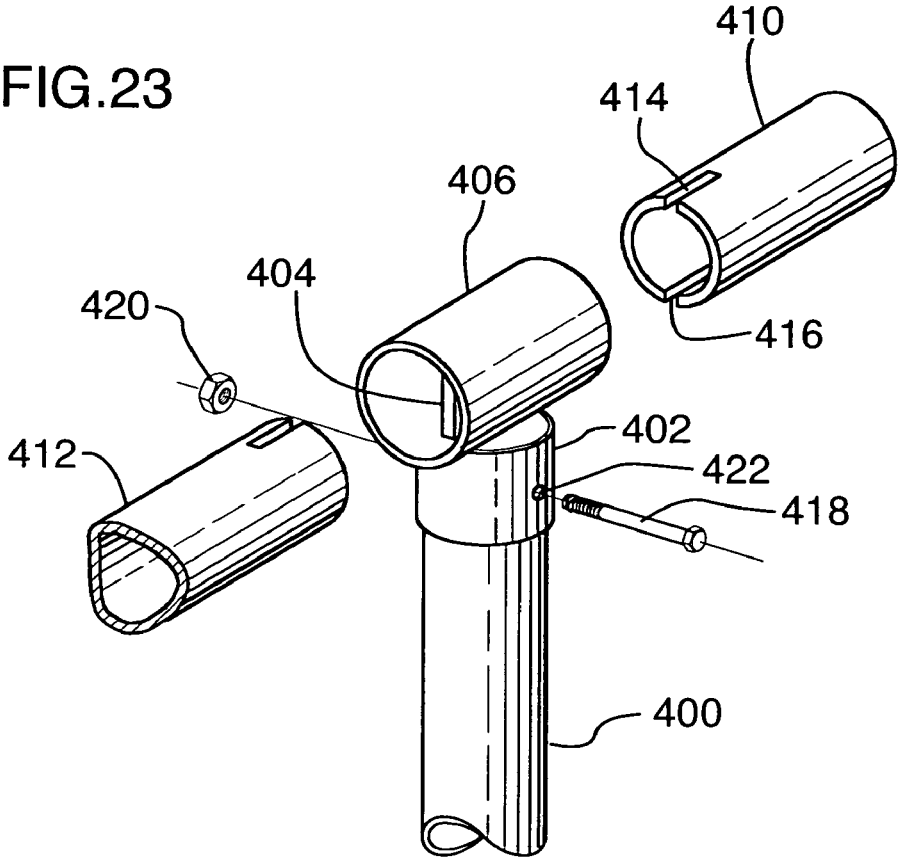
FIG. 24 is an isolated perspective view of an alternative embodiment of the connector, top portion of the support post, and rail members.

It will be appreciated that in an alternative embodiment a different connector may be employed to fasten rail members to posts. An example of such an alternative embodiment is shown in FIGS. 23 and 24. The top end of post 400 is fitted with an end cap 402 having a planar member 404 projecting from the top end of the post. The fastening means includes a generally tubular connector 406 having a centre slotted aperture 408 adapted to receive the planar member 404. The connector 406 receives ends of the rail members 410 and 412. Each rail member end has opposing slotted apertures 414 and 416 that slidingly surround planar member 404 when the rail members engage the connector. The end cap 402 with planar member 404 may be integral with the post 400, may be secured to the post by bolt 418 inserted through aperture 422 and fastened with nut 420, or may be secured by other known and acceptable methods of attachment.

From the foregoing detailed description, it will be appreciated that the snow guard devices disclosed are versatile and may be used on different types of sloped roof surfaces (i.e. those having standing seams, corrugations or both). Moreover, as the snow guard devices are built-up structures, they may be easily scaled to accommodate the dimensions of a particular roof surface.

Although the above description and accompanying drawings relate to specific preferred embodiments of the present invention as presently contemplated by the inventor, it will be understood that various changes, modifications and adaptations may be made without departing from the spirit of the invention.

The embodiments of the invention in which an exclusive property or privilege is claimed are defined as follows:

1. A snow guard device for use on a sloped roof having a roof decking supported by a roof substructure, the roof decking having a plurality of roof panels mounted side-by-side, the plurality of roof panels being attached along their respective adjoining edges to form a plurality of elongate standing seams, the standing seams extending in a direction substantially parallel to the slope of the sloped roof, and being transversely spaced along the roof decking, the snow guard device comprising:

support means mountable through an opening in the roof decking, the support means being connectable to spaced-apart longitudinal support means mounted below said roof decking to the roof substructure when the snow guard device is operatively connected to the sloped roof;

rail means for mounting on the support means transversely of the standing seams and in vertically spaced relation to the roof decking;

bracket means rigidly attachable to the rail means; and snow barrier means supportable on the bracket means to impede snow from downwardly sliding along the roof decking, the snow barrier means being positionable between a pair of adjacent standing seams at a location upslope of the support means.

2. A snow guard device according to claim 1 wherein the support means includes two posts, the posts being transversely spaced from each other to support the rail means when the snow guard device is operatively connected to the sloped roof.

3. A snow guard device according to claim 2 wherein the posts are positionable to extend substantially perpendicular to the roof decking.

4. A snow guard device according to claim 2 wherein the posts are positionable to extend in substantially skewed relation relative to the roof decking.

5. A snow guard device according to claim 2 wherein the longitudinal support means includes two longitudinal support members mounted substantially perpendicular to the roof substructure.

6. A snow guard device according to claim 5 wherein the rail means includes a rail member, the rail member being positionable to extend between the posts.

7. A snow guard device according to claim 6 wherein:

each post has a top end for fastening to the rail member and a bottom end for anchoring to the longitudinal support member; and the snow guard device further includes fastening means for firmly securing the rail member to the top end of each post.

8. A snow guard device according to claim 7 wherein the fastening means includes a connector formed with a passageway adapted to receive an end of the rail member therethrough in substantial close fitting contact; the connector having a generally planar face for abutting the top end of the post, and a pair of flanges extending beyond the planar face for fastening to the top end of the post.

9. A snow guard device according to claim 7 wherein the rail member has opposing slotted apertures at the ends thereof and the fastening means includes a generally tubular connector adapted to receive an end of the rail member therethrough in substantial close fitting contact and the connector having a centre slotted aperture adapted to receive a planar member projecting from the top end of the post.

10. A snow guard device according to claim 6 wherein the bracket means includes a plurality of pairs of brackets mountable side-by-side for attachment to the rail member.

11. A snow guard device according to claim 10 wherein each pair of brackets is mountable between a pair of adjacent standing seams.

12. A snow guard device according to claim 11 wherein each pair of brackets is positionable to extend upslope and substantially downwardly toward the roof decking.

13. A snow guard device according to claim 12 wherein the plurality of pairs of brackets includes a first pair of brackets, a second pair of brackets and a third pair of brackets; the first, second and third pairs of brackets being mountable in transversely spaced relation to each other.

14. A snow guard device according to claim 13 wherein one of the brackets of the first pair is positionable in abutting relation with one of the brackets of the second pair.

15. A snow guard device according to claim 6 wherein the bracket means includes a pair of brackets mountable between a pair of adjacent standing seams.

16. A snow guard device according to claim 15 wherein each pair of brackets is positionable to extend upslope and substantially downwardly toward the roof decking.

17. A snow guard device according to claim 16 wherein:

each bracket has a proximal portion for attaching to the rail member, a distal portion for locating adjacent the roof decking, and an intermediate portion joining the proximal portion to the distal portion;

the snow barrier means being mountable between the distal portions of the brackets.

18. A snow guard device according to claim 17 wherein:

each bracket has a flange member reinforced with a web member, the web member extending between the proximal and distal portions of the bracket;

the snow barrier means being attachable to the web members of the brackets at the distal portions thereof.

19. A snow guard device according to claim 17 wherein the proximal portion of each bracket includes a clevis for fastening engagement with the rail member.

20. A snow guard device according to claim 17 wherein each bracket has a generally doglegged profile.

21. A snow guard device according to claim 20 wherein the generally doglegged profile of each bracket is defined by a first bend formed therein at the juncture between the proximal portion and the intermediate portion, and a second bend formed therein at the juncture between the intermediate portion and the distal portion.

22. A snow guard device according to claim 20 wherein the generally doglegged profile of each bracket is defined by a bend formed therein at the juncture between the proximal portion and the intermediate portion.

23. A snow guard device according to claim 1 wherein the snow barrier means includes at least one cross-beam sized to substantially correspond to the transverse spacing between a pair of adjacent standing seams.

24. A snow guard device according to claim 23 wherein the snow barrier means includes three cross-beams.

25. A snow guard device according to claim 24 wherein when operatively connected to the bracket means, the three cross-beams co-operate with each other to define a snow abutting face; the snow abutting face being positionable substantially perpendicular to the roof decking.

26. A snow guard device according to claim 25 wherein the snow abutting face is directed away from the guide means.

27. A snow guard device according to claim 24 wherein when operatively connected to the bracket means, the three cross-beams co-operate with each other to define a snow abutting face; the snow abutting face is positionable to have a generally skewed orientation relative to the roof decking.

28. A snow guard device according to claim 1 wherein the bracket means and the snow barrier means are integrally formed.

29. A snow guard device for use on a sloped roof having a roof decking supported by a roof substructure, the roof decking having a plurality of elongate corrugations extending substantially parallel to the slope of the roof decking, and being transversely spaced along the roof decking, the snow guard device comprising:

support means mountable through an opening in the roof decking, the support means being connectable to spaced apart longitudinal support means mounted below said roof decking to the roof substructure when the snow guard device is operatively connected to the sloped roof;

rail means for mounting on the support means transversely of the corrugations and in vertically spaced relation to the roof decking;

bracket means rigidly attachable to the rail means; and snow barrier means supportable on the bracket means to discourage snow from downwardly sliding along the roof decking, the snow barrier means being positionable between a pair of adjacent corrugations at a location upslope of the support means.

* * * * *